US005809738A

United States Patent [19]

Stephens et al.

[11] Patent Number: 5,809,738

[45] Date of Patent: Sep. 22, 1998

[54] PACKAGING SYSTEM

[75] Inventors: Brad Stephens, Centerville, Minn.; Duane Raymond, Sommerset, Wis.; Gregory M. Fulkerson, Maple Plain, Minn.

[73] Assignee: Thiele Engineering Company, Minneapolis, Minn.

[21] Appl. No.: 451,860

[22] Filed: May 26, 1995

Related U.S. Application Data

[63] Continuation of Ser. No. 964,671, Oct. 21, 1992, abandoned, which is a continuation-in-part of Ser. No. 756,308, Sep. 6, 1991, Pat. No. 5,237,795.

[51] Int. Cl.[6] ..... B65B 5/10; B65B 35/30; B65B 35/54

[52] U.S. Cl. ..... 53/154; 53/566; 53/534; 53/251

[58] Field of Search ..... 53/154, 534, 566, 53/250, 251, 284, 387.2

[56] References Cited

U.S. PATENT DOCUMENTS

| | | | |
|---|---|---|---|
| 1,866,885 | 7/1932 | Ferguson | 53/387.2 |
| 2,876,608 | 3/1959 | Vergobbi | 53/387.2 |
| 3,138,076 | 6/1964 | Lobdell | 53/566 X |
| 3,333,514 | 8/1967 | Jones | 53/566 X |
| 4,308,712 | 1/1982 | Hagedorn | 53/566 |
| 4,633,655 | 1/1987 | Nigrelli | 53/566 X |
| 4,901,501 | 2/1990 | Raudat et al. | 53/251 X |

*Primary Examiner*—Linda Johnson
*Attorney, Agent, or Firm*—Hugh D. Jaeger

[57] ABSTRACT

A high speed multiple conveyor packaging system having product separating bars that separate a product into specific sized groups on moving opposing conveyors. Two product streams diverge to meet the separating bars, and subsequently reconverge after separation for loading into a carton or package. Separated conveyed product is channeled from opposing conveyors into another conveyed product carton from opposing carton ends. A tight package is formed by sets of formed guide bars which cause the package flaps to be stretched or formed to the position of maximum tightness about the product.

29 Claims, 30 Drawing Sheets

PACKAGING SYSTEM

CROSS-REFERENCES TO APPLICATIONS

This patent application is a continuation of U.S. patent application Ser. No. 07/964,671, filed Oct. 21, 1992, now abandonded, which is a continuation-in-part of U.S. patent application Ser. No. 07/756,308, filed Sep. 6, 1991, entiled "Packaging System" issued Aug. 24, 1993, as U.S. patent No. 5,237,795 to the same assignees as this patent application.

BACKGROUND OF THE INVENTION

1. Field of the Invention

This invention relates to equipment for loading multiple product units into a sleeve-type package. In particularly, the invention relates to machines for loading cans or bottles or similar cylindrical geometric objects into cartons.

2. Description of the Prior Art

A multitude of apparatus has been used for loading packages with sets of individual product. In particular, the techniques for loading cardboard sleeve-type packages with cans or bottles are manifold.

Cans of beverage are commonly sold in cardboard 12-packs or 24-can cases. The package is a cardboard sleeve into which the cans or bottles are slid from the end. The ends of the sleeve are then folded and glued to seal the individual products in place.

The present invention relates to conveyor belt loaders for such cardboard containers. There is a wealth of patent art in this area, as well as prior art machines which have not been disclosed in patents. The common thread through these disclosures is a central conveyor with transverse bars which separate the open sleeved containers, and hold them as the conveyor moves. Separate side conveyors for feeding cans into the sleeves come in from an angle on either side of the central conveyor. The cans are urged into the container sleeve as the conveyors converge.

Two main tasks that must be accomplished are sorting of cans on the side conveyors into sets for loading, and the actual loading of the cans into the sleeves.

The teachings of the prior art are in two main sets.

The first set of prior art involves devices that separate the cans on the outer conveyor with means extending inwardly from the outer side of the apparatus. Some prime examples of this type of structure are U.S. Pat. No. 3,332,199 to Wong, issued Jul. 20, 1967, U.S. Pat. No. 3,300,947 to Fahrenbach, issued Jan. 31, 1967, and U.S. Pat. No. 3,037,431 to McGihon, issued Jun. 5, 1962. Other such art is illustrated by U.S. Pat. No. 2,974,454 to Andre et al., issued Mar. 14, 1961, and U.S. Pat. No. 3,778,959 to Langen, et al., issued Dec. 18, 1973.

In this first class of prior art various types of fingers or extensions come inwardly from the outside of the device to separate the product, such as cans, into sets. This is done as a first step before the cans are fed into containers on the central conveyor. For example, in the McGihon patent there is a disk with projections which mark off sets of cans. As the disk rotates, a set of cans, for example three in the McGihon disclosure, is isolated between the pairs of fingers. This set then travels down the conveyor into the sleeve.

In the Fahrenbach disclosure, there is a belt having projections which isolate cans. A belt-driven wheel then has a pair of fingers which divide the cans into sets in a manner somewhat similar to McGihon. After separation, the sets of cans are urged into the containers by the merging of the conveyors.

The Wong patent also has a belt bearing fingers which separates sets of cans. The cans are urged into the sleeve by the action of the conveyor merging with the central conveyor.

All of these side-actuated devices have their benefits and their failings. One problem with such side separation of the cans using these prior art techniques is that it was necessarily slow. The complex mechanical arrangement of belts, gears, and projecting fingers had too many moving parts to operate in a rapid manner. It is desirable for today's can loaders to operate in a range of 1,800 to 2,400 cans per minute. Such rapid movement of cans into sleeves cannot be accomplished with these complex belt and finger systems.

A second class of prior art devices involves separator bars or flight bars on the central conveyor which preform a dual task. These bars both 1) hold the sleeved container on the central conveyor, and 2) separate the cans into sets. One example of such dual function flight bar or metering bar is the Thiele Suntan lotion machine, which was commercially available in 1972. This early Thiele machine was shown to have speeded up the process by having a simple mechanism. The flight bar had wedge shaped ends which entered the stream of product as the conveyors merged and thereby metered the product. The flight bars also urged the product into the sleeves which were held by the flight bars.

A second example of this combined technique is U.S. Pat. No. 4,237,673 to Calvert et al., issued Dec. 9, 1980, which operates in the same manner as the Thiele suntan lotion machine. As in the early Thiele machine, the Calvert structure uses dual-purpose central metering bars with wedged shaped tips which preform the dual functions of separating the cans as they come down a diagonal conveyor and also of holding the container sleeves on the central conveyor.

The dual purpose metering bar has prove to be a successful device for years, but it does not allow speeds sufficient to satisfy today's demands.

What is needed in order to speed up loading to meet today's production standards is a can loader which separates the functions of isolating sets of cans for loading and for holding the container sleeves, without using the complex belt, sprocket and finger techniques of the prior art.

SUMMARY OF THE INVENTION

A package loader constructed according to the present invention includes a central conveyor for carrying multiple container sleeves and at least one side conveyor mounted to meet the central conveyor at an acute angle for directing a stream of product carried by the side conveyor into the sleeved containers. The loader includes a separator bar conveyor mounted generally outboard from and generally parallel to the side conveyor. The separator conveyor carries separator bars which extend into the stream of product on the side conveyor for separating product into sets for later loading into sleeves.

The apparatus preferably has two side conveyors which run generally parallel at a first end of the apparatus, then diverge outboard of a first end of the central conveyor. The side conveyors later reconverge to meet two sides of the central conveyor. The separator conveyor preferably involves first and second conveyors having separator bars continually moving along the separator conveyor. As the side conveyors, bearing a stream of product, diverge, the stream comes in contact with the inwardly projecting separator bars. The separator bars are inserted through the stream as the stream diverges outward to meet the separator bars. After the side conveyors reconverge, the separator bars come free of the stream of containers which is entering the package, and follow the separator conveyor under the product stream and go back to the first end to restart the cycle.

The multiple conveyor scheme of the present invention allows for extremely fast carton loading. The separator bar conveyors have very few moving parts and no complex equipment is needed to separate the product into sets. The present invention overcomes the problems of slower speed in the prior art. By separating the function of can separation from carton holding, the present invention accelerates the process. The bottle neck of the dual function central flight bar is avoided. The present invention also avoids the complex belt and sprocket schemes of the prior art.

A first alternative embodiment features a package loader having a package transfer section between a central conveyor and prior to an outflow conveyor section where a packaged product is urged through without suffering package distortion, as no or little side pressure is applied to the packaged product. Also featured are opposing and independently adjustable guide plates aligned parallel to the central axis, each of which may be adjusted by using only one of many adjustment screw locations. These opposing adjustable guide plates each have a plurality of components mounted thereupon, such as plows, guides, or conveyors, all of which move inwardly or outwardly in unison, thus alleviating the need for multiple adjustments of various components when reconfiguring for different sized product packages. Package jam up is also alleviated by the use of a high-speed off-load conveyor, which removes packaged product at a rate higher than that of the other conveyors found in the package loader. Each successive conveyor operates at a speed higher than the preceding conveyor to minimize and/or eliminate packaged product backup.

A second alternative embodiment illustrates a variation of the first alternative embodiment where an additional pressure belt system is employed in overlapping proximity with the package transfer mechanism where the package is driven or grasped during passage by both the package transfer mechanism and the overlapping pressure belt system. In this second alternative embodiment, the package transfer mechanism and the overlapping pressure belt systems are driven by different mechanical power sources. The out flow conveyor system containing the pressure belt system can continue to operate even with stoppage of up stream packaging devices, such as when a downed can or a missing can is detected so as to clear the output end of the machine. The up stream portion can be stopped rapidly in the event of a downed or missing can.

In the case of a controlled stop, there is only one flex pack in the chain portion of the transfer, thus allowing the belt portion of the transfer to continue to run to clear out the machine. In the case of an emergency stop, the whole machine stops, thus causing a possible ram in the transfer because an E-stop throws the timing off. This case is acceptable in an E-stop.

One significant aspect and feature of the present invention is that a missing or downed can in any set of cans can be sensed prior to the set of cans or objects being loaded into the carton.

Another significant aspect and feature of the present invention is to provide for a tight and secure package about the objects, such as cans. The package provides that all of the objects, such as cans, are aligned with respect to each other.

A further significant aspect and feature of the present invention is a package transfer section allowing minimal contact or distortion of packaged product through the package loader.

Yet another significant aspect and feature of the present invention is opposing adjustable guide plates having single point adjustment for the components mounted thereon.

Still a further significant aspect and feature of the present invention is the use of conveyors or other conveyance systems, each of which provides for increased speed of packaged product throughout with respect to each preceding stage.

Another significant aspect and feature of the present invention is the use of a package transfer section in an overlapping position with respect to a pressure belt system in the outflow conveyor section.

Another significant aspect and feature of the present invention is a support plate to aid and assist in a smooth transfer of a package from a central loading conveyor to the outflow conveyor.

Another significant aspect and feature of the present invention is a off load conveyor having a split tail shaft for expediting belt replacement procedures.

Having thus described the embodiments of the present invention, it is a principal object hereof to provide a packaging system for packaging of objects, such as cans, into a predetermined pattern, load the objects into a carton in the pattern, and secure the flaps to secure the objects in the carton with respect to each other.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
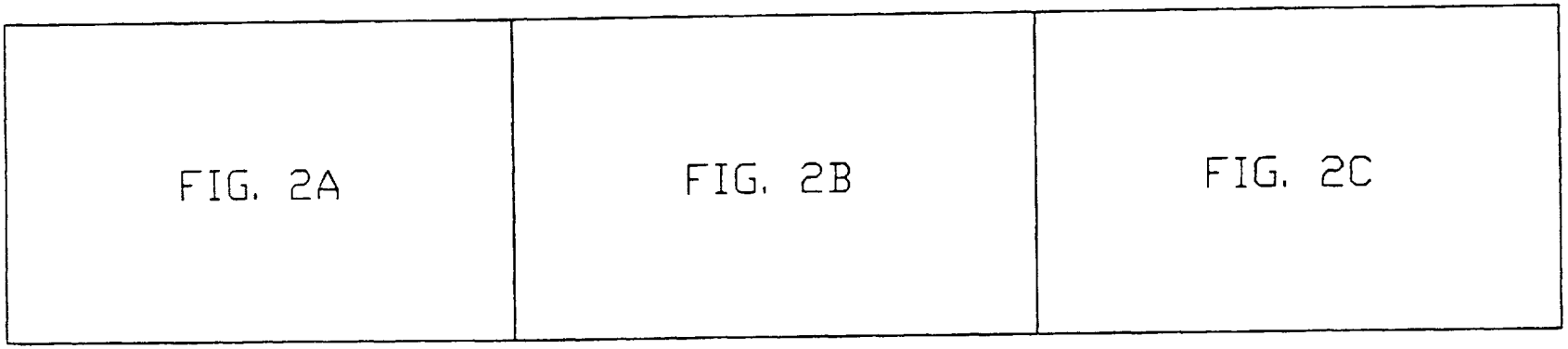
FIG. 1 illustrates the alignment of FIGS. 2A, 2B, and 2C.
Figure 2A:
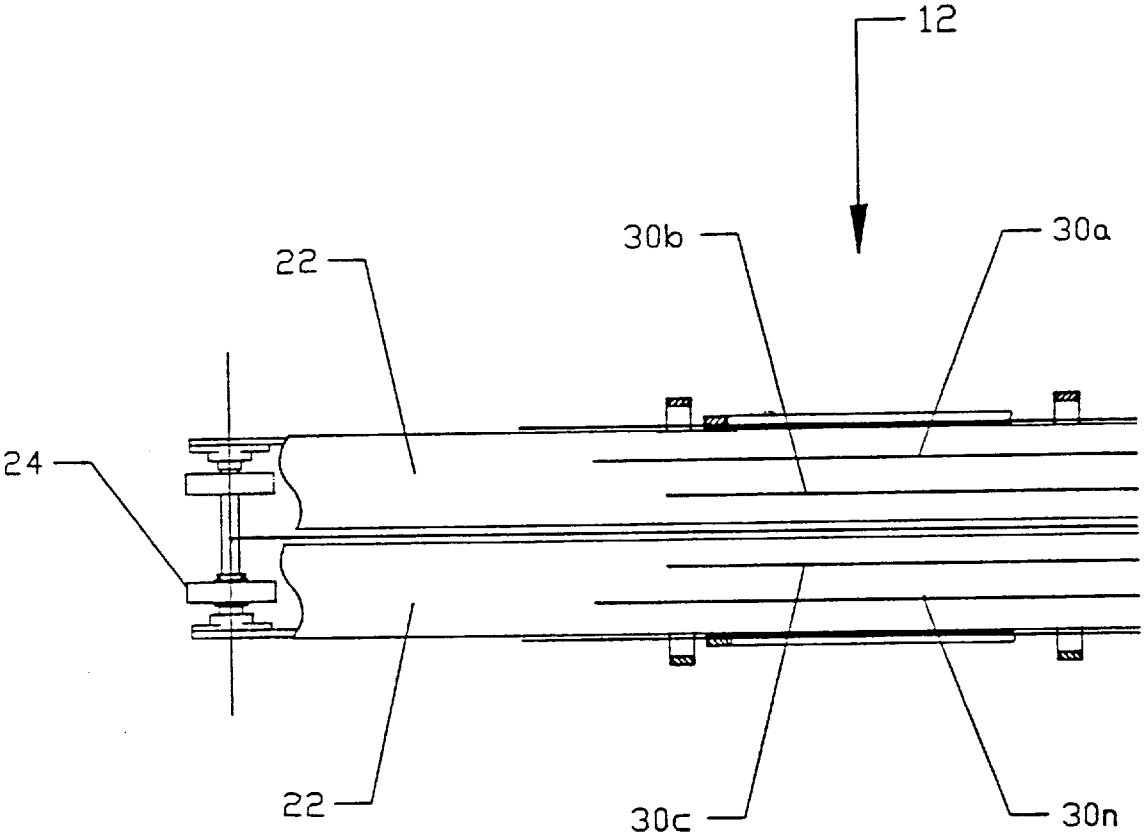
FIGS. 2A, 2B, and 2C illustrate a top plan view of a package loader constructed according to the present invention.
Figure 2B:
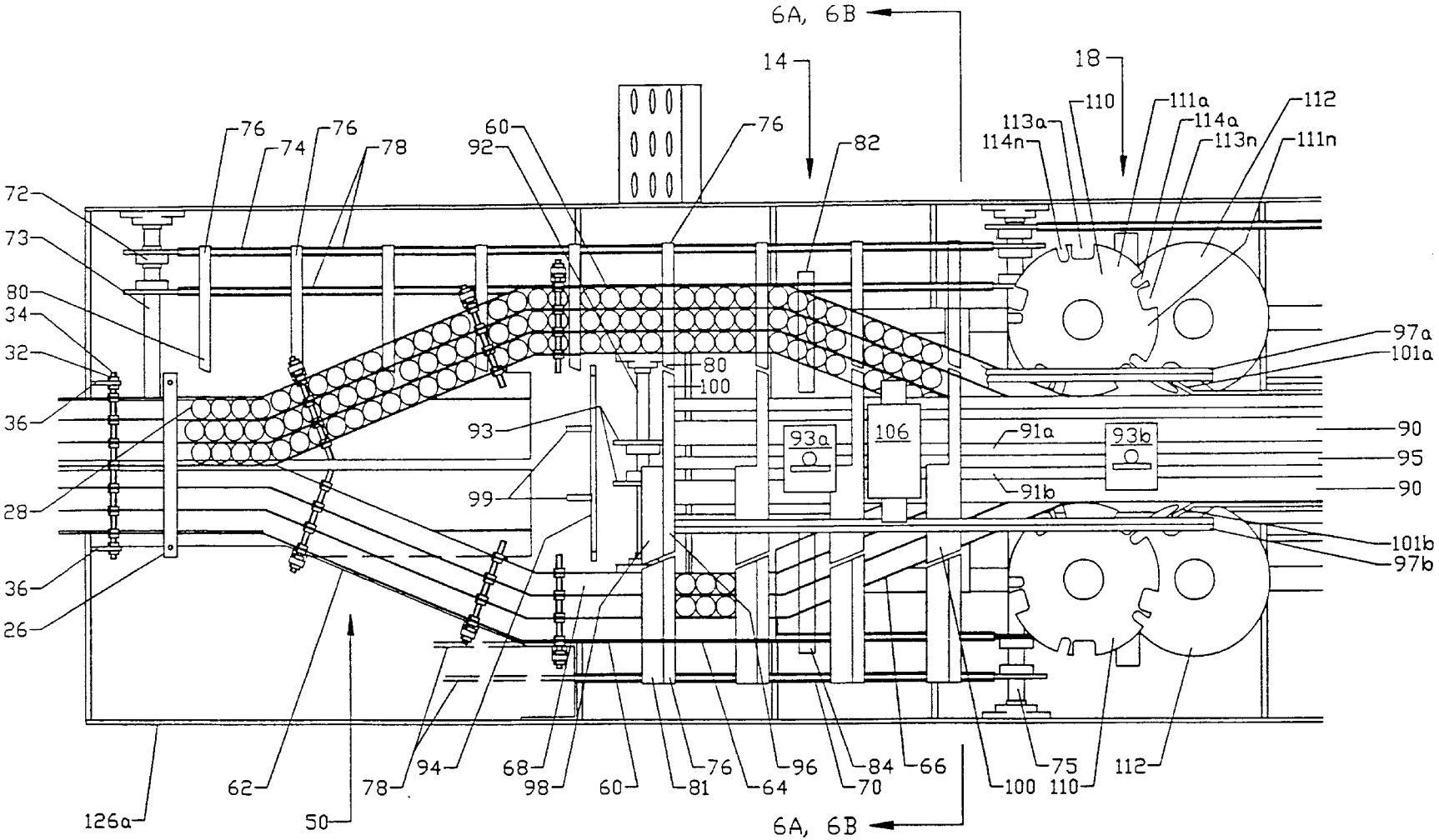
Figure 2C:
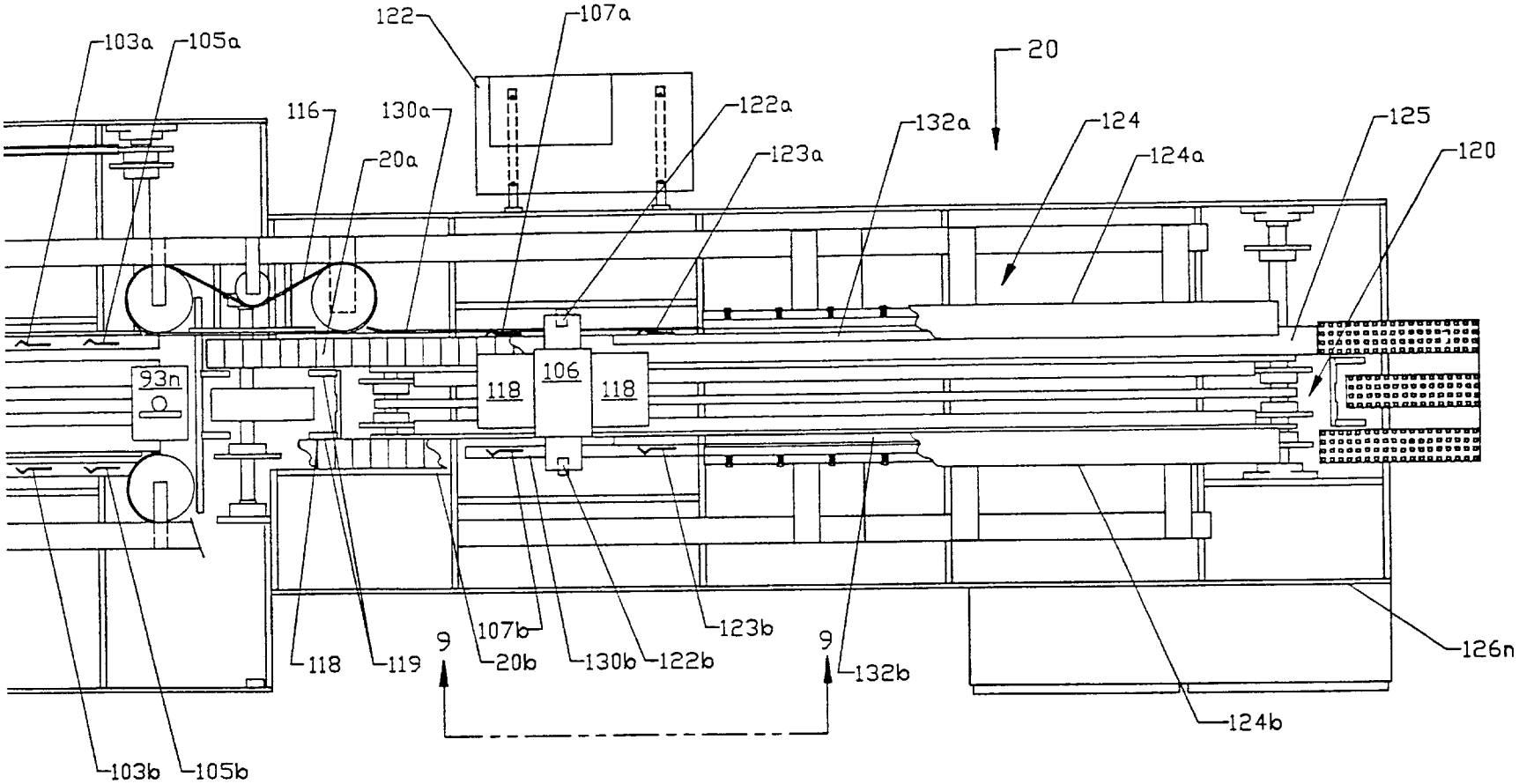

FIG. 1 illustrates the alignment of FIGS. 2A, 2B and 2C.

Figure 4A:
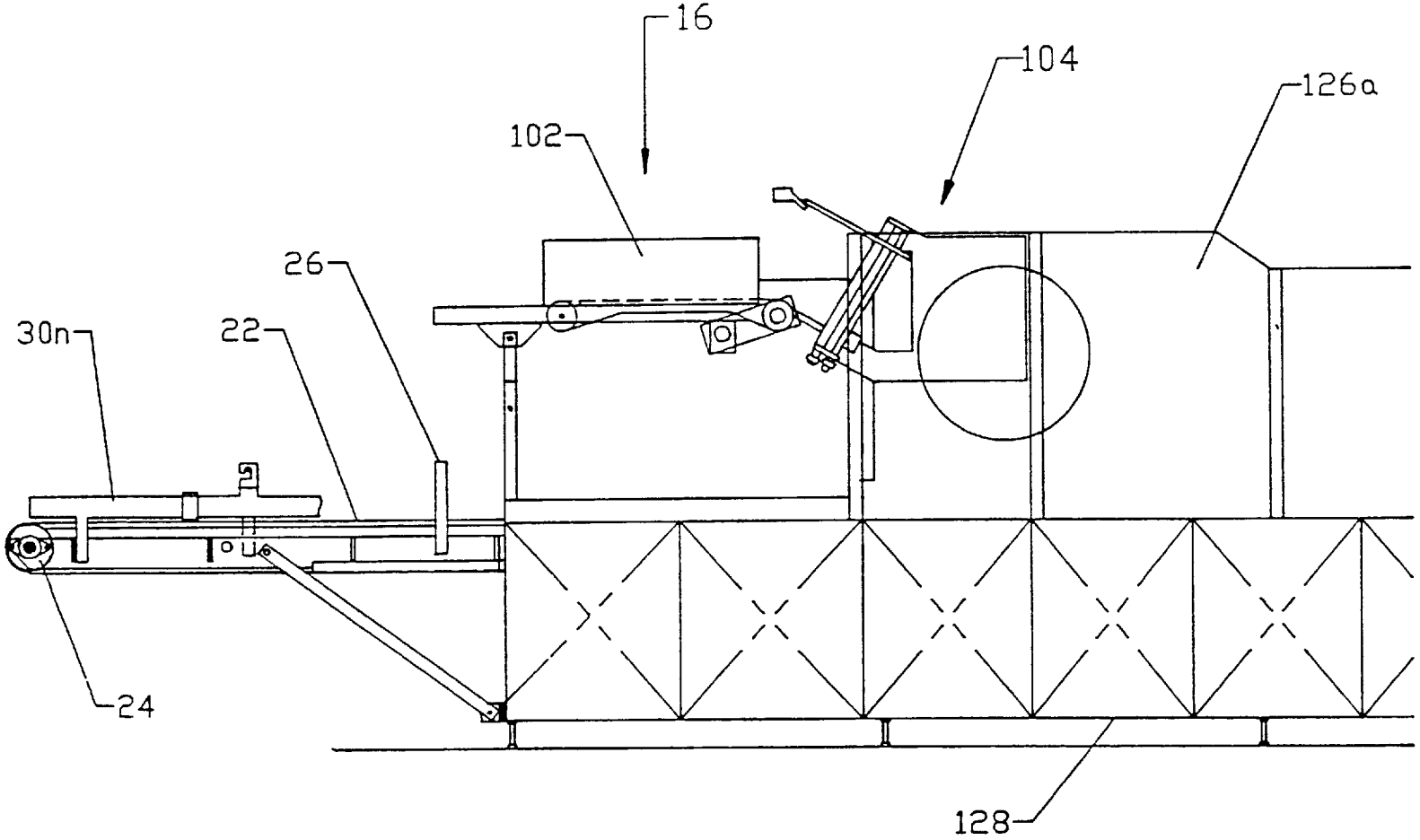
FIGS. 4A and 4B illustrate a side plan view of the package loader of FIGS. 2A–2C.
Figure 4B:
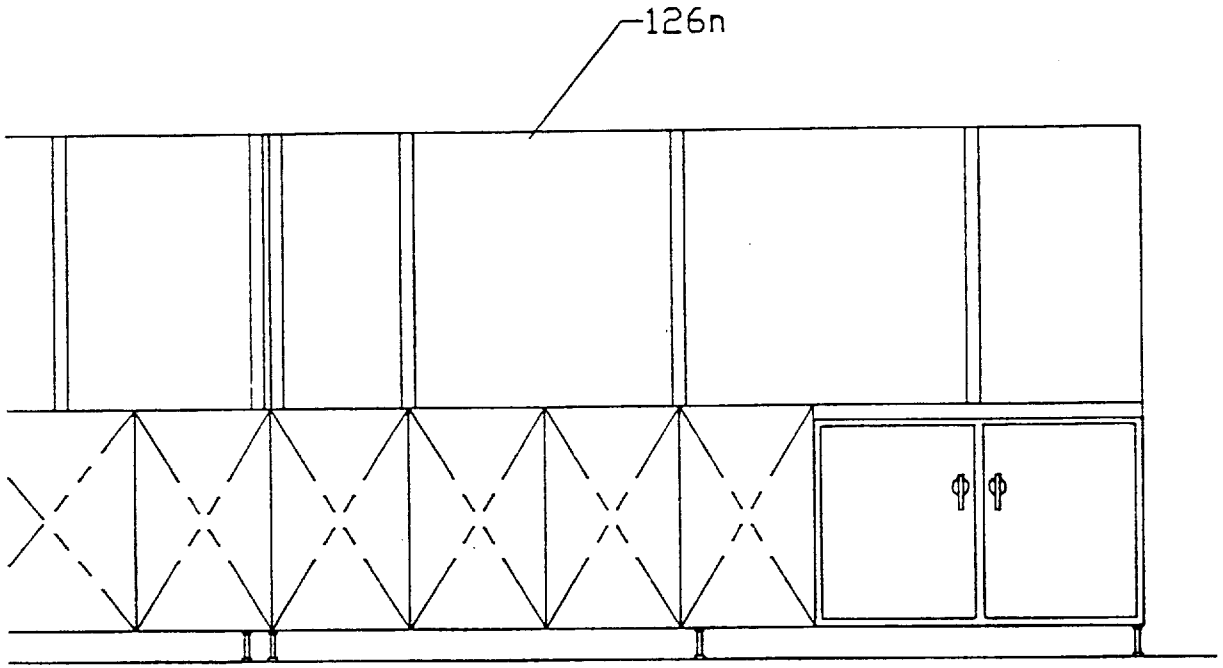

FIGS. 2A, 2B, and 2C illustrate a top plan view of the package loader 10 including an in-feed section 12, product packing section 14, carton assembly section 16 of FIGS. 4A–4B, carton gluing section 18, and outflow conveyor section 20.

In-feed section 12 includes in-feed conveyor 22 which is moved by a drive system 24, and a product sensor 26.

The in-feed conveyor 22 is preferably constructed to 7.5" wide Rexnord brand tabletop chains driven by a 1 horsepower drive motor and a one-way clutch. Product 28 is transferred to the in-feed conveyor 22 by any type of prior art equipment desired by the user.

Guide rails 30*a*–30*n* are mounted over an in-feed conveyor 22 to separate product 28 into the number of desired lanes. For example, when filling 24-pack cases of cans, six lanes are used; when filling 12-packs of cans, four lanes are used. While the present invention is described in terms of a device for inserting cans into containers, the apparatus may be used by one skilled in the art by various other types of product.

Guide rails 30*a*–30*n* are suspended from supports 32, which include a threaded rod 34 mounted on side members 36. Guide rails 30*a*–30*n* are affixed to the threaded rod 34 and separated by nuts mounted on the threads.

Figure 7:
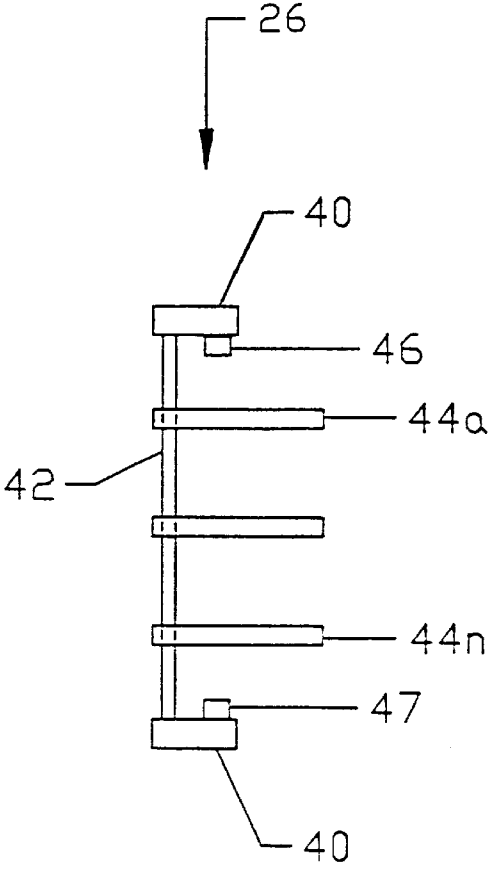
FIG. 7 illustrates a top plan view of the can sensor of FIGS. 2A–2C enlarged.
Figure 8:
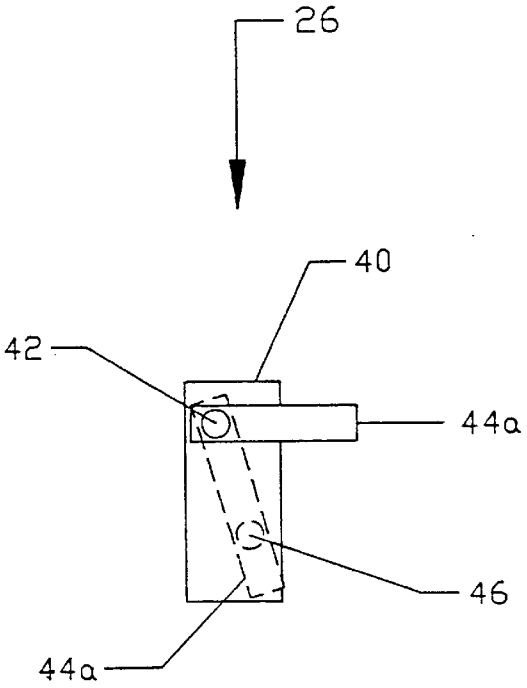
FIG. 8 illustrates a side view of the can sensor of FIG. 7.

A product sensor 26 best illustrated in FIGS. 7 and 8, determines if product is missing from the stream or is dislodged from proper position. A pair of side supports 40 support a rod 42 extending transversely across in-feed conveyor 22. A plurality of nylon detection fingers 44*a*–44*n* are mounted in a rotatable manner on rod 42. There is preferably one detection finger for each lane in the apparatus.

A photo-eye transmitter 46 transmits normally to a photo-eye receiver 47 when the product 28 is in its proper position. The top of the product 28 holds fingers 44*a*–44*n* in an elevated position. When no product 28 is present, one or more of the fingers 44*a*–44*n* falls to the position such as shown in dotted lines in FIG. 8, blocking photo-eye transmitter 46 transmission to the photo-eye receiver 47. This would happen if there is a can missing on the conveyor, or the can has fallen down.

When photo-eye receiver 47 senses product error, it signals the system control that there is a product error. Photo-eye transmitter 46 and photo-eye receiver 47 are electronically connected to the system under control so that all detected errors are transmitted to allow the system controller to signal the users to take corrective action.

Guide rails 30*a*–30*n* begin to angle outwardly in area 50 at preferably a 22° angle, or any other suitable angle, with respect to in-feed conveyor 22. Guide rails 30*a*–30*n* in angled area 50 begin to separate the flow of product 28 into two diverging streams near the inboard end of in-feed conveyor 22.

A pair of mirror-image stationary guide decks 60 on either side of package loader 10 move product 28 from in-feed conveyor 22 further along the system. Each guide deck 60 includes a first angled section 62, straight section 64 and second inwardly angled section 66. First angled section 62 is designed to mate at the preferable 22° angle, or any other suitable angle, against the side of in-feed conveyor 22 so that lane area 68 of guide deck 60 aligns with lanes of product guided by corresponding guide rails 30*a*–30*n* of in-feed section 12. Therefore, product 28 moves down in-feed conveyor 22, is guided at an angle in angled area 50 of guide rails 30*a*–30*n*, and then is slid off in-feed conveyor 22 onto the fixed lane area 68 of guide deck 60 by the guide rails 30*a*–30*n*. Product 28 continues to flow through the guide deck 60 by the force of flow of successive product 28 coming off of in-feed conveyor 22. In other words, in-feed conveyor 22 is an active conveyor, whereas guide deck 60 is a passive conveyor where cans are only moved by the pressure of the product stream.

First and second separator bar conveyors 70 are mounted on opposite sides of package loader 10 outboard from in-feed conveyor 22 and guide deck 60. The conveyors 70 has a drive system 72, including a drive shaft 73 and another shaft 75, which moves sets of bar mounts 74 through a range from area 50 where guide rails 30*a*–30*n* start to diverge from conveyor 22 up to a point where product 28 is loaded.

Each pair of separator bar mounts 74 carries a separator bar 76. The separator bars 76 are constructed of hard core aluminum and are mounted to the separator bar mounts 74 which in turn are mounted to two chains 78 which are moved by drive system 72. Separator bars 76 have an angled inner end 80.

As product 28 is moving generally from left to right in FIGS. 2A–2C, mirror image chains 78 are also moving separator bars 76 in a parallel path at generally the same speed. As shown in the Figures, separator bars 76 extend inwardly from chains 78. At the beginning of separator bar conveyor 70, separator bars are in free air spaced apart from the stream of product 28. As the separator bars 76 and product 28 move down the system, guide rails 30*a*–30*n* begin to guide product 28 outwardly at a 22° angle. This is continued as guide deck 60 picks up product 28 and continues its outward diverging path. As the stream of product 28 diverges outwardly, the angled edge 80 of the separator bar 76 is inserted in product stream between successive product 28.

Separator bars 76 are spaced on separator bar conveyor 70 to divide product 28 into sets as it progresses down guide deck 60. In the example illustrated, product 28 is divided into sets of 12. This means that 12 units of product 28 will be inserted into the container from each side, making a 24-container case. In this manner, product 28 is divided into sets with a minimum of moving parts in separator bar conveyor 70. No complex finger mechanism is needed to separate the product 28. Product 28 is separated into sets long before the loading process. This avoids the bottle neck of dual function separator bars. Separation does not slow down the later product loading process.

When 12-packs are being filled, a second bar 81 is mounted against each separator bar 76 to adjust spacing as shown on the right side of FIG. 2B. When 24-can cases are being filled, bars 81 are rendered.

Once separator bars 76 engage product 28 and divide the stream into sets of product 28, the separator bars 76 move product 28 along through guide deck 60 so that product 28 is no longer propelled merely by the force of successive product in the stream. Separator bars 76 move product 28 along guide deck 60 into second angled section 66 which diverges inwardly preferably at a 22° angle. Second and third product sensors 82 and 84 sense whether any product is missing or have fallen in guide deck 60. Product sensors 82 and 84 are constructed in the manner as product sensor 26, and are electrically connected to system controller in the same manner for signaling a product placement error.

A central conveyor 90 is the focus of loading operations. Control conveyor 90 has a first end at a point where guide deck 60 has diverged, so that central split loading conveyor 90, with mirror image like halves, comes up in the middle of package loader 10 between the two guide decks 60. The central loading conveyor 90 is moved by drive system 92 and like opposing chains 93 and carries carton flight bars 94. Flight bars 94 run along a central flight guide 95 and are illustrated having a fixed portion 96 and a removable portion 98. The spacing between flight bars 94 is adjusted by removing removable portion 98, such as for 24-can product operation, and replacing it with a different width portion. Alternatively, removable portion 98 may be left out, such as for 12-pack product packaging′ opposing finger members 99 extend vertically from the flight member 44 to assist a package carton along the central loading conveyor 40.

Central loading conveyor 90 is synchronized in timing with the separator bar conveyor 70. Carton flight bars 94 are positioned generally the same distance apart as separator bars 76, and are timed so that they match one-for-one with each said separator bar 76. The outboard end 100 of each flight bar 94 is shaped to generally mate with the angled end 80 of separator bar 76. The shape of end 100 is not important in that it does not engage product 28, but it should be shaped to generally mate with angled end 80 either by forming an angle or a step so that there is no large gap between flight bar 94 and separator bar 76.

Carton assembly section 16 illustrated in FIGS. 4A–4B includes a hopper 102 and a rotary placer 104. Here cartons are placed on the conveyor 90 between successive flight bars 94 and positioned across from adjacent separator bars 76 in oncoming product 28 in the lane area 68 for subsequent loading. Cartons are loaded into the hopper in horizontal position with the manufacturer's joint in the carton down and trailing. The cartons are urged into the hopper 102 by three powered belts. A vibrator on the incline hopper assists in feeding the cartons to the front of the hopper. Hold back clips hold the cartons in the pick position, while allowing clearance of the cartons as they are pulled from the hopper by vacuum cups on rotary placer 104.

Rotary placer 104 has four heads. Each rotary head has a vacuum cup shaft on which two vacuum cup stems are mounted. The rotary head is gear driven in a planetary motion around horizontal drive shaft. The horizontal drive shaft rotates 120° from the hopper to the placement position. During each revolution of the horizontal drive shaft, the vacuum cup shafts each rotate three times. When the vacuum cups contact the front carton in the hopper 102, the vacuum pressure in the cups attaches the carton to the cups. When the vacuum cups are rotated to the place position, the vacuum cup extends straight up and down and the carton is inserted between a pair of successive carton flight bars 94. At this place position, the vacuum cup is vented to atmosphere and the carton is released to be held by flight bars 94. At this point, the carton is in the open position where its cross section is rectangular, and is ready to receive product 28.

In operation, as central loading conveyor 90 is moving flight bars 94 down the center of package loader 10, product 28 is being moved down guide deck 60 by separator bars 76. Product 28 in the straight section 64 of guide deck 60 has diverged out of the center of package loader 10, and one of the flight bars 94 comes up from below the system on the central loading conveyor 90 and mates against the two opposing separator bars 76. From this point, the unified combination of flight bar 94 and the two opposing separator bars 76 moves together through product packing section 14 of package loader 10.

When each guide deck 60 begins to converge again towards the center of package loader 10 through second angled sections 66, product 28 follows the plurality of lane area 68 of guide deck 60 onto central loading conveyor 90. As angled section 66 nears central loading conveyor 90, product 28 is urged onto conveyor 90 by bars 76. A product 28 enters conveyor 90 it begins to be engaged by flight bars 94. As angled section 66 converges with conveyor 90, flight bars 76 loose contact with product stream 28 and return under the system back again to the beginning of separator bar conveyor 70. Once the opposing flight bars 76 are disengaged from the stream of product 28, product 28 is guided into centrally located cartons 106 as the angled sections 66 merge with central loading conveyor 90.

A set of parallel hold down bars 91*a*–91*b* secure to a plurality of pneumatically adjustable plates 93*a*–93*n*, suspend longitudinally over and above the top of carton 106, and extend to the area of the compression belts 116. A set of parallel opposing longitudinal upper flap guides 97*a*–97*b* hold the upper carton flaps in a horizontal or above horizontal position so that product can be loaded into the interior of the cartons 106.

This technique allows a rapid stream of transfer of product 28. For example, an embodiment loading 12 oz. cans into 24-can cases, constructed according to the present invention, is capable of loading 2,400 cans per minute. The smooth operation of externally intruding separator bars 76 and carton holding flight bars 94 allows for fast movement of product 28.

After leaving product packing section 14, the carton 106, filled with product 28, enters carton loading section 18. A can seating wheel 110 on either side of central loading conveyor 90 assist in final loading of the product 28 in the carton 106. There are cutouts or recesses on the can seating wheels 110 to clear the leading and trailing carton flaps during this sealing process, whereby the can seating wheels 110 contact product 28 without disturbing the flaps. Rotary tucker wheels 112 are mounted on vertical shafts to rotate relative to the central conveyor. The leading carton flap is plowed closed by a recess on the can seating wheel 110, and then the rotary tucker wheels 112 close the trailing flaps. Plows 101*a* and 101*b* hold both leading and trailing flaps closed as the carton 106 moves down stream.

Upper and lower flap plows 103*a*–103*b* and 105*a*–105*b* are positioned down stream of the rotary tucker wheels 112 to close the upper and lower flaps. Opposing plows

103*a*–103*b* firstly maneuver the bottom flaps upwardly, and secondly the opposing plows 105*a*–105*b* maneuver the top flaps downwardly over the bottom flaps. The mirror image can seating wheels 110 include a plurality of can seating cams 111*a*–111*n* for final positioning of the product cans within the carton 106 from both ends of the carton 106. A plurality of recesses 113*a*–113*n* and 114*a*–114*n* flanking the can seating cams 111*a*–111*n* serve to hold the dust flaps open and away from the sides of the carton ends so that the can seating cams 111*a*–111*n* may have unrestricted access to the carton ends. Recess closes the leading edge dust flap. Opposing rotary tucker wheels 112 turn five times the rate of the can seating wheels 110, and include a recess 115 for closure of the trailing edge flap. Compression belts 116 then engage the closed carton 106.

The compression belts 116 transfer cartons 106 to a plurality of discharge flights 118 mounted on outflow conveyor section 20. The discharge flights 118 include a plurality of like opposing vertically oriented finger members 119. The outflow conveyor section 20, including conveyor belts 20*a* and 20*b*, is an active conveyor which is moved by drive system 120 to move cartons 106 out of package loader 10. Like other flight bars in the package loader 10, discharge flights 118 are constructed of hard coated aluminum. The spacing between discharge flights 118 is adjustable in a similar fashion to carton flight bars 94. Only a small number of discharge flights are illustrated for purposes of brevity and clarity of illustration.

Figure 10:
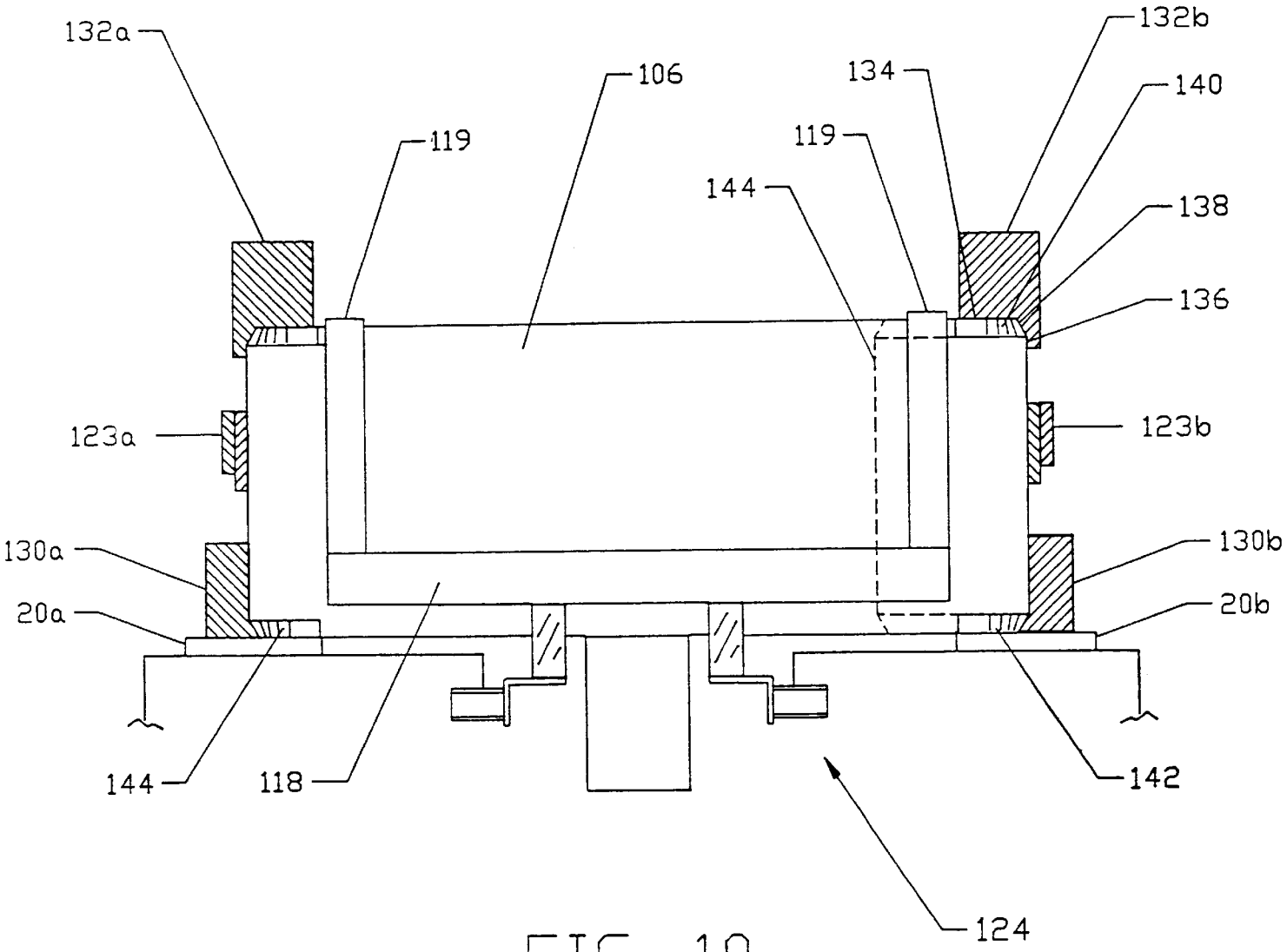
FIG. 10 illustrates a cross-sectional view of the upper and lower formed guide bars along line 10—10 of FIG. 9.

The conveyor belts 20*a* and 20*b* and discharge flights 118 carry the carton 106 containing product to the right so that opposing plows 107*a* and 107*b* engage and turn the upper flaps horizontal. Hot opposing Nordson glue systems 122*a* and 122*b* then apply hot glue to the lower flaps after which opposing plows 123*a*–123*b* position the upper flaps downwardly over the lower flaps. The lower portion of the carton 106 is also guided by opposing formed guide bars 130*a* and 130*b*. The upper portion of the carton 106 is guided by opposing formed upper guide bars 132*a* and 132*b*. The carton 106 engages the upper and lower guide bars 130*a*–130*b* and 132*a*–132*b* to form the carton upper and lower flaps about the beveled product can top and bottom edges, thus positioning the upper and lower flaps in their most advantageous position for tight packaging about the product as illustrated in FIG. 10.

Nordson glue systems 122*a*–122*b*, or other similar hot melt glue systems, are used to glue flaps on cartons 106 in a manner known in the prior art. A compression station 124 having opposing longitudinal compression members of which sides 125*a* and 125*b* are illustrated, is down stream from the glue systems 122*a* and 122*b* to compress the flaps on carton 106 to make sure the glue sets. In the preferred embodiment, compression station 124 is 6 feet long.

The apparatus constructed of the present invention greatly speeds up the product-loading techniques of the prior art. While the concept of converging product streams being loaded into a central carton is attempted in numerous prior art devices, none of them achieve the speeds and consistency of the present invention. The prior art techniques, where the central flight bar both separates cans into sets and holds the cartons, could not achieve these speeds. The prior art techniques of belt and finger methods to separate cans into sets are simply not fast enough or dependable enough to match today's speed requirements. By having a conveyor with separator bars merging into product stream from the outside and then having cartons held by separate flight bars in the central conveyor, dependability and speed can be achieved. Those skilled in the art may adapt the present invention to load any type of product which is suitable for conveyance by angled feed into containers.

Figure 3:
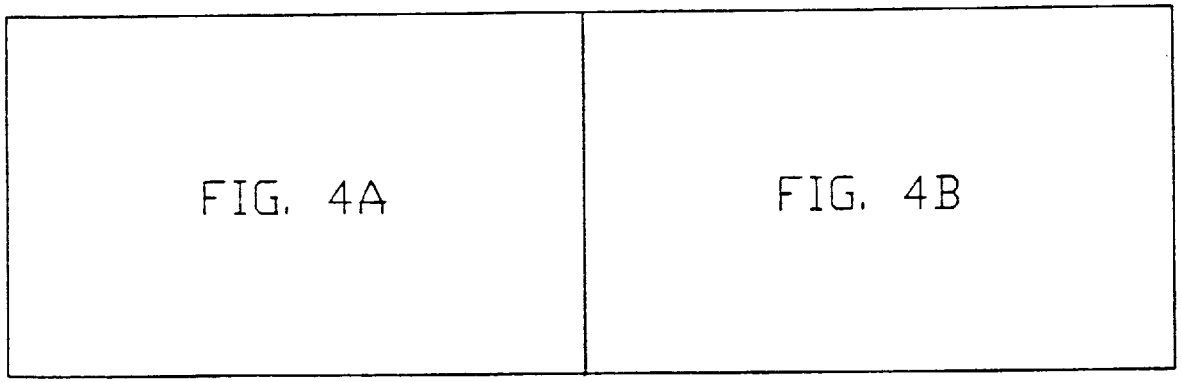
FIG. 3 illustrates the alignment of FIGS. 4A and 4B.

FIG. 3 illustrates the alignment of FIGS. 4A and 4B.

FIGS. 4A and 4B illustrate a side plan view of the package loader 10 of FIGS. 2A–2C where all numerals correspond to those elements previously described. Illustrated in particular is the hopper 102 and the rotary placer 104. A plurality of clear panels 126*a*–126*n* align about the upper portion of the package loader 10 above the bottom enclosure 128.

Figure 5:
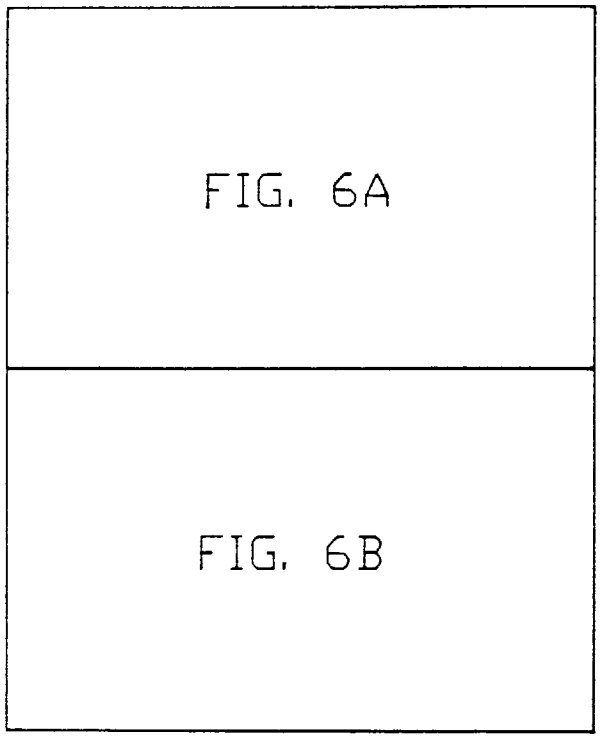
FIG. 5 illustrates the alignment of FIGS. 6A–6B.
Figure 6A:
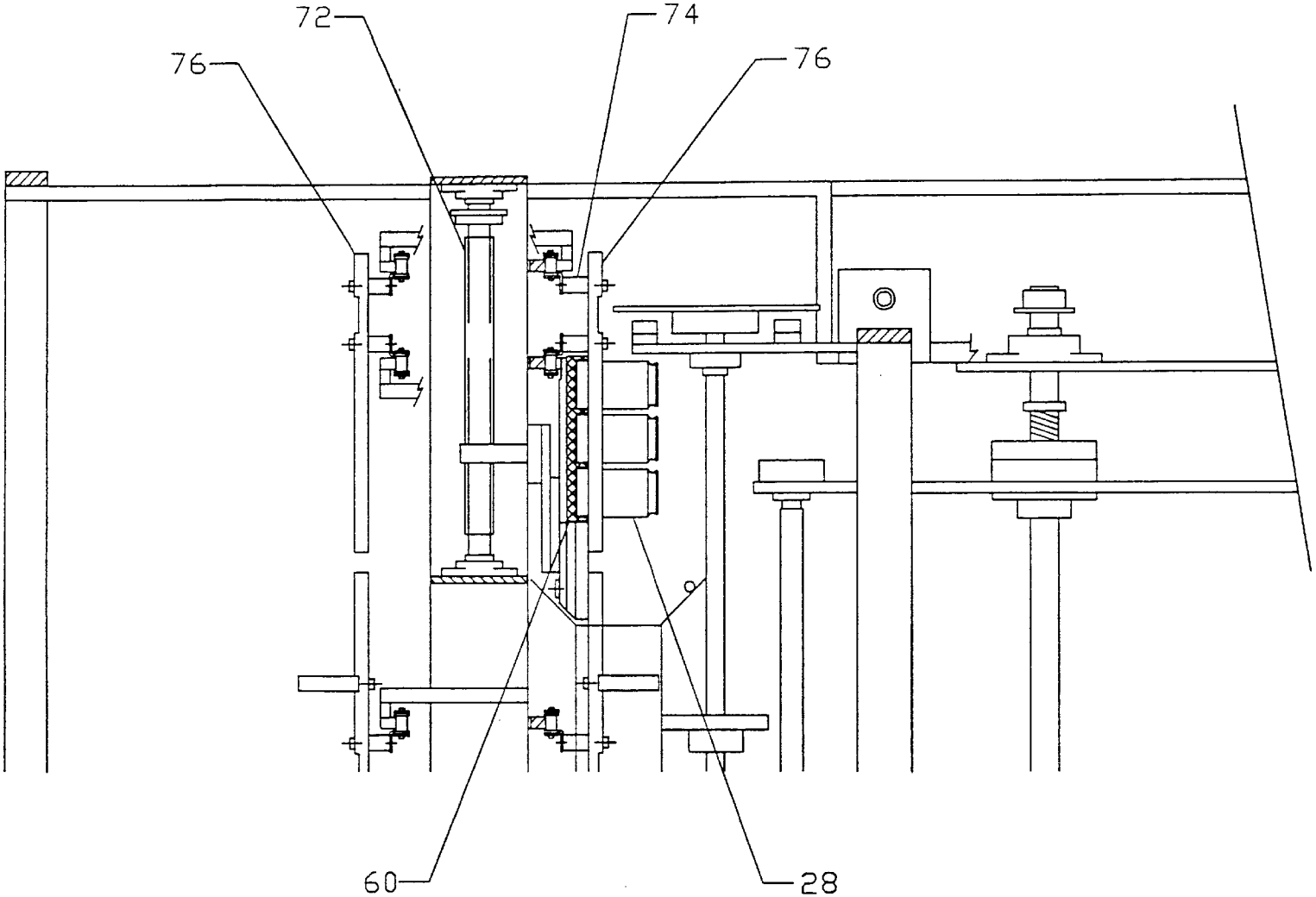
FIGS. 6A and 6B illustrate a cross-sectional view taken on line 4—4 of FIGS. 2A–2C.
Figure 6B:
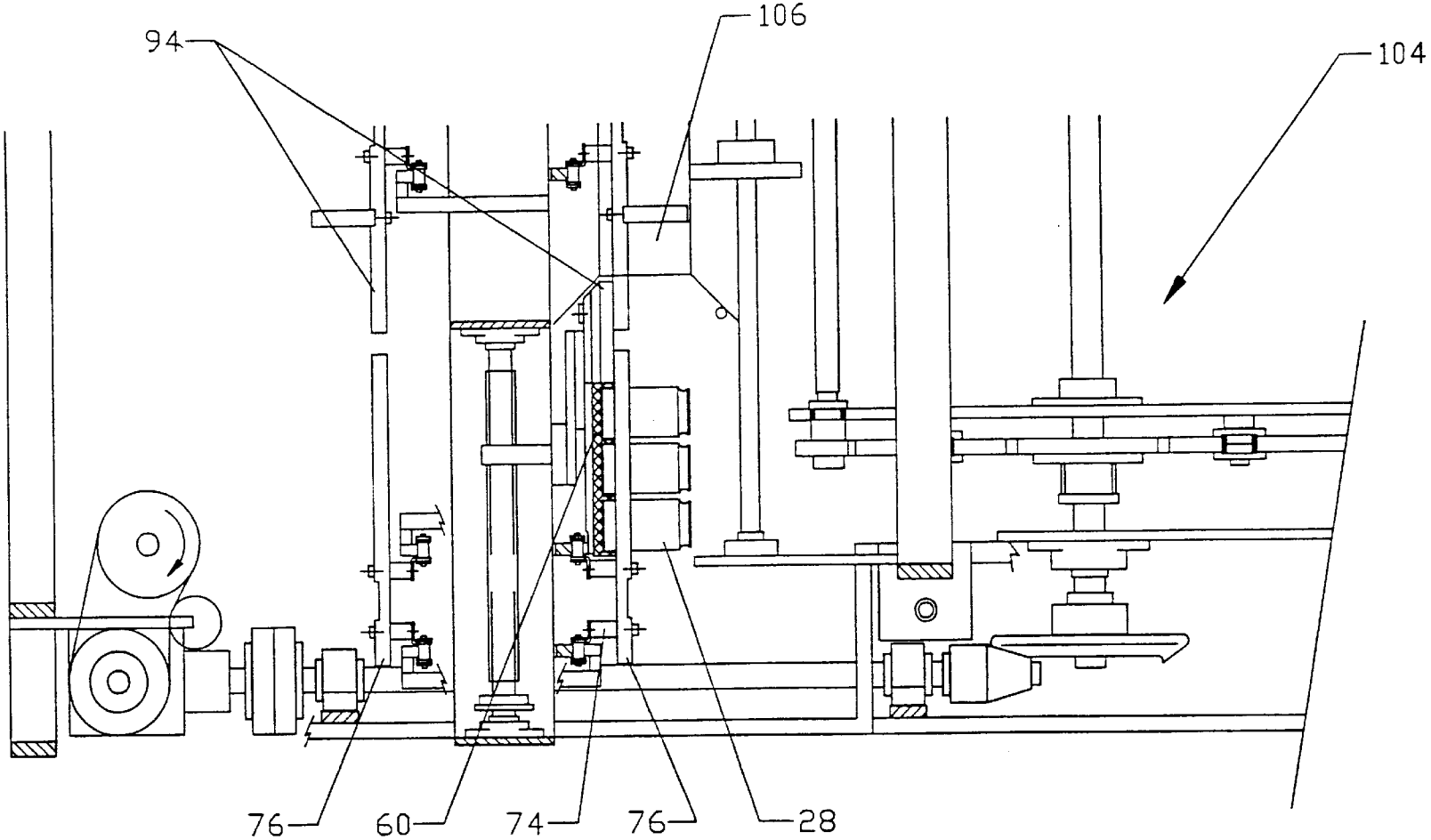

FIG. 5 illustrates the alignment of FIGS. 6A and 6B.

FIGS. 6A and 6B illustrate a cross-sectional view along line 6—6 of FIGS. 2A–2C where all numerals correspond to those elements previously described.

FIG. 7 illustrates a top view of the product sensor 26 where all numerals correspond to those elements previously described.

PIG. 8 illustrates a side view of the product sensor 26 where all numerals correspond to those elements previously described.

Figure 9:
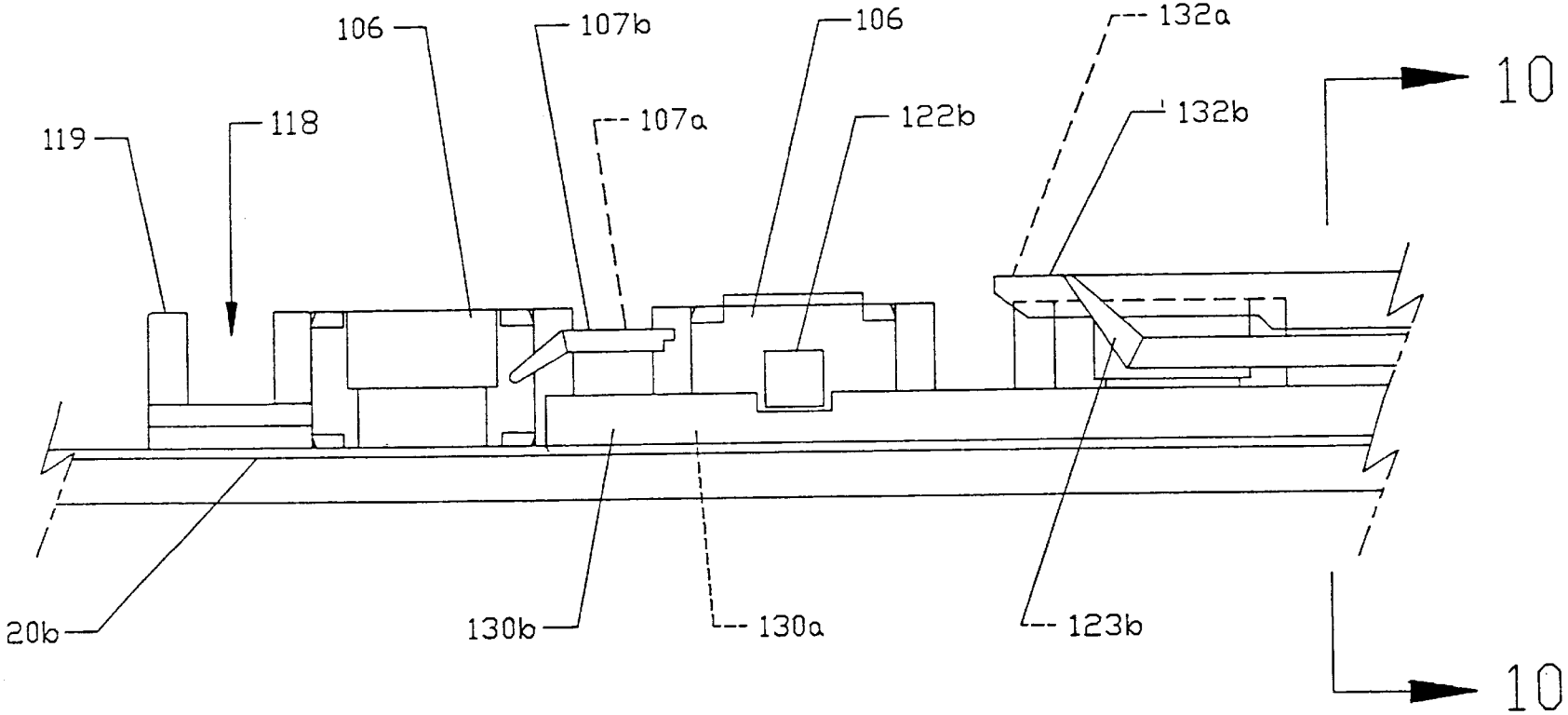
FIG. 9 illustrates a side view of the upper and lower formed guide bars.

FIG. 9 illustrates a view along line 9—9 of FIG. 2C where all numerals correspond to those elements previously described. Illustrated in particular are the upper and lower formed guide bars 132*a*–132*b* and 130*a*–130*b*, respectively, which cause the major flaps of the carton 106 to be formed snugly over and about the beveled corner of the product cans as described in FIG. 10.

FIG. 10 illustrates a cross-sectional view of the formed guide bars 132*a*–132*b* and 130*a*–130*b* where all numerals correspond to those elements previously described. Each of the formed guide bars include vertical and horizontal surfaces joined by a chamfered surface. For purposes of example and illustration the upper formed guide bar 132*b* has a horizontal guide surface 134 and a vertical guide surface 136 with an interceding chamfered guide surface 138. Similar surfaces are also used in the other formed guides 132*a*, 130*a* and 130*b*. The beveled surface 138 of each formed guide bar insures that the flaps are held tight against the upper and lower beveled edges 140 and 142 of a product can 144 to provide a tight "wrap" about the product cans 144 in the carton 106. Holding the upper flap tight against the upper beveled can edge 140 allows the bottom edge of the upper flap to be positioned further down on the carton side. In a like manner holding the lower flap tight against the lower beveled can edge 142 allows the upper edge of the lower flap to be positioned further up on the carton side. Tight wrapping provides for a more secure package with improved integrity due to the fact that the product cans are more secure and less apt to cause carton or product damage as caused by shifting contents of loosely packaged items which can self-destruct from the inside out.

MODE OF OPERATION

Appendix 1 is a part of this specification of the patent application for the operation of the packaging system for packing patterns of cans into a cardboard carton, whereupon cans are firmly positioned with respect to each other and the flaps are forced together and glued as illustrated in FIG. 10. This packaging system operates at high packaging speed and provides a secure positioning of all the cans with respect to each other in the carton as illustrated in FIG. 10.

DESCRIPTION OF THE FIRST ALTERNATIVE EMBODIMENT

Figure 11:
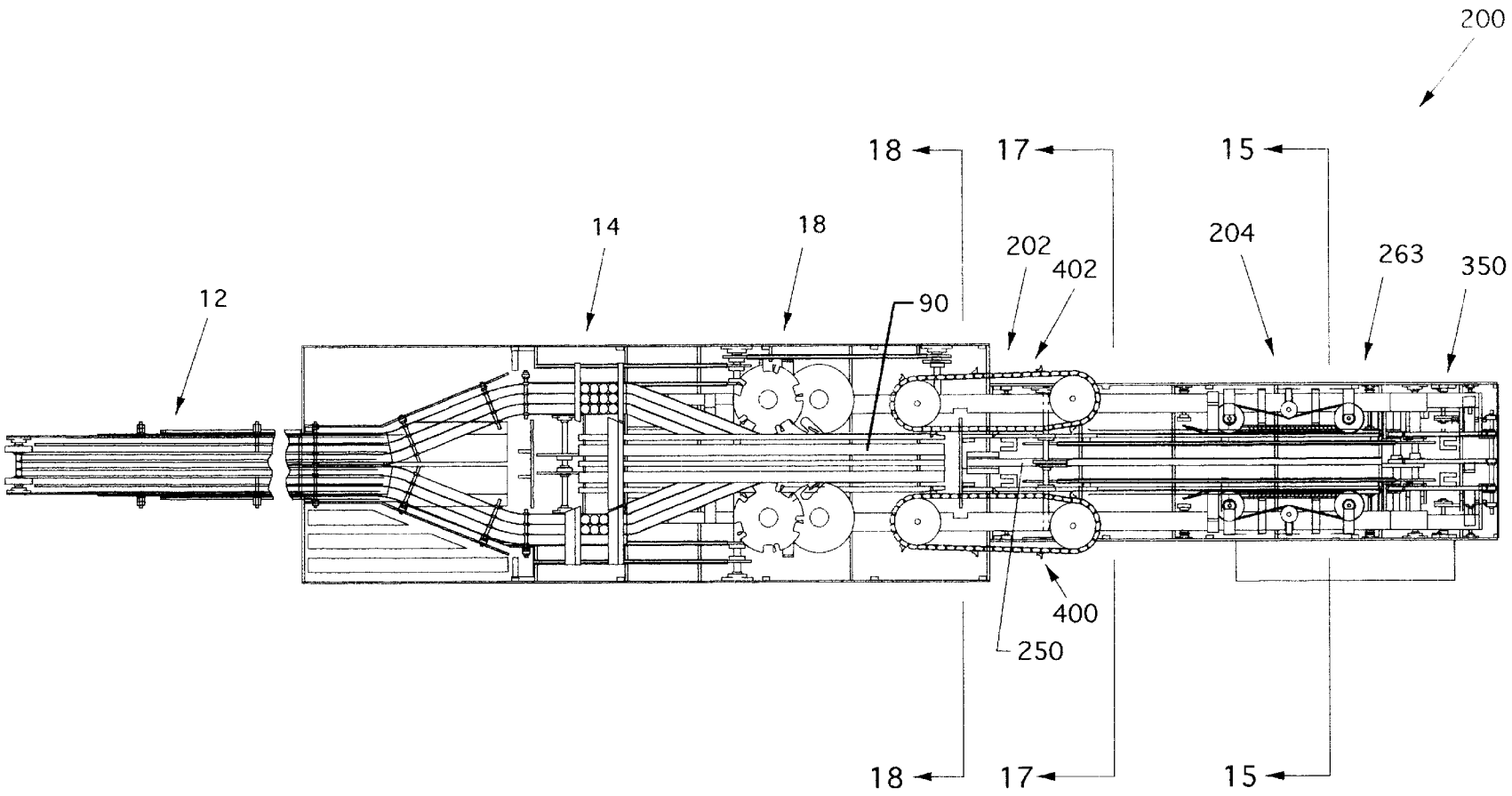
FIG. 11, a first alternative embodiment, illustrates a top plan view of a package loader constructed according to the present invention.

FIG. 11, a first alternative embodiment, illustrates a top plan view of a package loader 200 where all numerals correspond to those elements previously described. Included in the package loader 200 are an in-feed section 12, a product packaging section 14, a carton assembly section 16 of FIGS. 4A–4B, a carton gluing section 18 of the previous figures, and a package transfer section 202 transitioning to an outflow conveyor section 204. The package transfer section 202 replaces the compression belts 116 of FIGS. 2A–2C, and is used to transport product-laden cartons to the outflow conveyor section 204 after passing through the carton gluing section 18. The package transfer section 202 and the outflow conveyor section 204 are illustrated in detail in the following figures.

Figure 12:
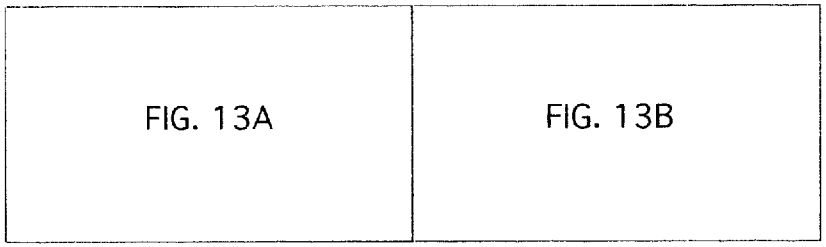
FIG. 12 illustrates the alignment of FIG. 13A with respect to FIG. 13B.
Figure 13A:
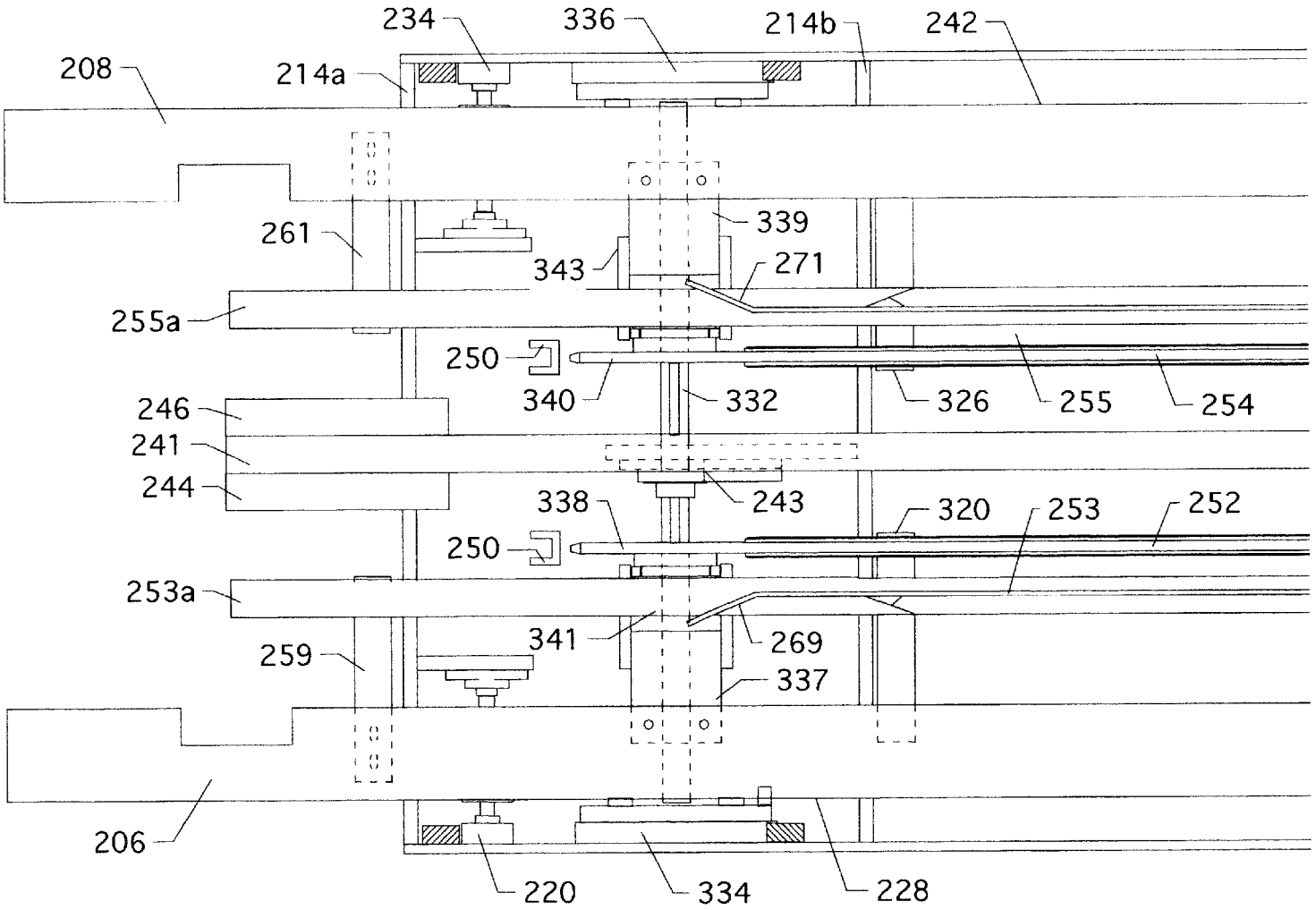
FIGS. 13A and 13B illustrate a top plan view of the outflow conveyor section.
Figure 13B:
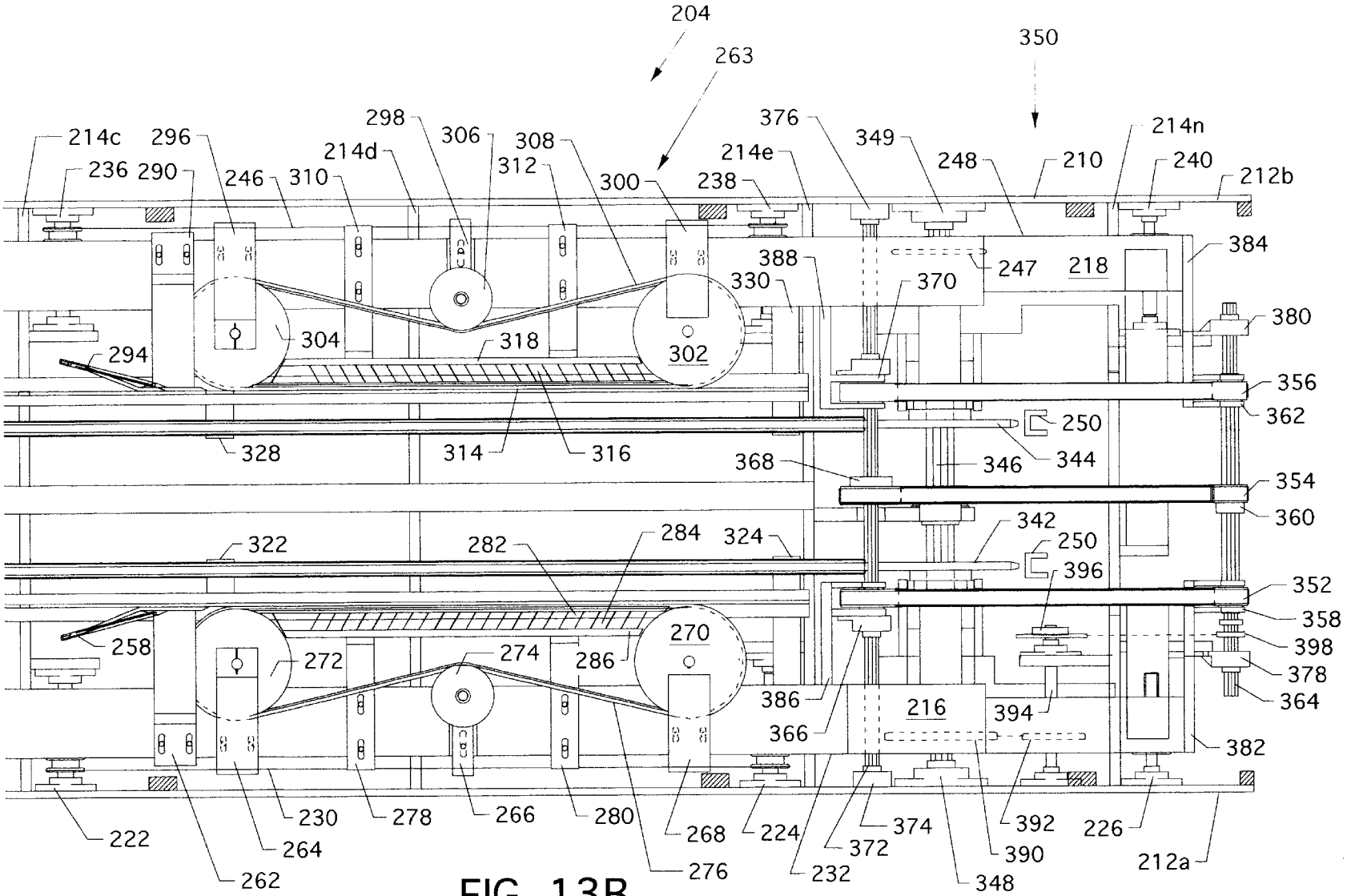

FIG. 12 illustrates the alignment of FIGS. 13A and 13B.

FIGS. 13A and 13B illustrate a top view of the outflow conveyor section 204 where all numerals correspond to those elements previously described. The package transfer section 202 is not illustrated over the left portion for purposes of brevity and clarity. The outflow conveyor section 204 includes independently opposing adjustable guide plates 206 and 208, which adjust inwardly and outwardly across the conveyor framework 210, which includes a plurality of longitudinal members 212*a* and 212*b* and a plurality of crossbar members 214*a*–214*n* aligned between the longitudinal members 212*a* and 212*b*. The adjustable guide plates 206 and 208 are supported on the cross bar members 214*a*–214*n*, and adjust inwardly or outwardly over the cross bar members 214*a*–214*n*. A multitude of members secure to the independently adjustable guide plates 206 and 208 for simultaneous movement of associated and attached members attached to each adjustable guide plate 206 and 208. Take-up brackets 216 and 218 secure to the adjustable guide plates 206 and 208 and are considered as a part of and an extension of the adjustable guide plates 206 and 208, respectively. Sprocketed adjustment screws 220, 222, 224 and 226 secure to the framework 210 as illustrated, and are mutually connected by chains 228, 230 and 232. Adjustment of any one of the sprocketed adjustment screws 220–226 causes corresponding movement of the remainder of the mutually connected adjustment screws to adjust the adjustable guide plate 206, and to mounted components inwardly or outwardly along the cross bar members 214*a*–214*n*. Numerous members are secured to the adjustable guide plate 206 which correspondingly move inwardly or outwardly across the cross bar members 214*a*–214*n*. Sprocketed adjustment screws 234, 236, 238 and 240 likewise secure to the conveyor framework 210, and are mutually connected by chains 242, 246 and 248 as illustrated for actuation of the adjustable guide plate and its mounted components inwardly or outwardly across the cross bar members 214*a*–214*n*. Both adjustable guide plates 206 and 208 adjust inwardly or outwardly to align with a series of flites 250, which operate along mutually adjusted central conveyor chain guide members 252 and 254, which are described later in detail.

A number of components are adjustably secured to the upper surface of the adjustable guide plates 206 and 208. Plow 258 secures via slotted bracket 262 to the adjustable guide plate 206, as well as slotted pulley brackets 264, 266 and 268. A pressure belt system 263 aligns downstream from the plow 258 to apply pressure to the package flaps during their transition along the outflow conveyor section, including a horizontally aligned drive pulley 270 secured to the slotted bracket 268, a tail pulley 272 secured to the slotted pulley bracket 264 and a take-up pulley 274 secured to the slotted pulley bracket 266. A compression belt 276 aligns over and about the drive pulley 270 and tail pulley 272. Slotted brackets 278 and 280 secure to the adjustable guide plate 206. A compression belt support 282, compression spring 284 and a compression spring backup 286 secure to the brackets 278 and 280. The opposing adjustable guide plate 208 has like and similar operating components secured to the upper surface of the adjustable guide plate 208, including slotted plow bracket 290, a plow 294, pulley brackets 296, 298 and 300, a drive pulley 302, a tail pulley 304, a take-up pulley 306, a compression belt 308, slotted brackets 310 and 312, a compression belt support 314, a compression spring 316, and a compression spring backup 318. The compression springs 284 and 316 provide for uniform and even pressure applied to the package flaps during their transition through the pressure belt system 263.

Secured to the under surface of the adjustable guide plates 206 and 208 are conveyor chain guides 252 and 254 and angled plastic guide members 253 and 255 via brackets 320, 322, 324, 326, 328 and 330, respectively. Planar plastic support members 253*a* and 255*a* align to and extend to the left from the angled plastic guide members 253 and 255, respectively, and secure via slotted brackets 259 and 261 to the adjustable guide plates 206 and 208, respectively. A middle planar plastic support member 241 aligns between the conveyor chain guides 252 and 254 and extends along the length of the outflow conveyor section 204. Shorter planar plastic support members 244 and 246 flank one end of the planar plastic support member 241 in planar alignment to lend support to a packaged product as it transitions from the package transfer section 202 to the outflow conveyor section 204. Plows 269 and 271 secure to the angled plastic guide members 253 and 255 to assist closure of the package major flaps. Planar plastic support members 253*a*, 241 and 255*a* are supported along their length by metal support bars 273, 275 and 277, respectively. The conveyor chain guides 252 and 254 being secured to the guide plates 206 and 208, are adjusted inwardly and outwardly as are other associated components with movement of the adjustable guide plates 206 and 208. A splined shaft 332 aligns between bearings 334 and 336 on longitudinal members 212*a*–212*b*, respectively. Yoke sprockets 338 and 340, which support glue guns 341 and 343 align over and about the splined shaft 332 and are secured to the under surfaces of the adjustable guide plates 206 and 208 by brackets 337 and 339. The conveyor chains (not illustrated) align over the conveyor chain guides 252 and 254 and the yoke sprockets 338 and 340, respectively. The yoke sprockets 338 and 340 adjust along the splined shaft 332 when adjustments inwardly or outwardly are made to the adjustable guide plates 206 and 208. In accordance, yoke sprockets 342 and 344 slidingly engage over and about a driven splined shaft 346 mounted between bearings 348 and 349 secured to the longitudinal framework members 212*a* and 212*b*. When inward or outward adjustments to the adjustable guide plates 206 and 208 are made, the yoke sprockets 342 and 344 slide along the driven splined shaft 346 in unison with yoke sprockets 338 and 340, the conveyor chain guides 252 and 254 and other members secured to the adjustable guide plates 206 and 208. A chain also aligns over a pulley 243 on the splined shaft 332 and a pulley 245 on the splined shaft 346. The splined shaft 346 and associated components are driven via a sprocket 247 on the splined shaft 364. An off-load conveyor system 350 includes a plurality of driven belts including belts 352, 354, and 356 aligned respectively over and about a yoke pulley 358, a pulley 360 and another yoke pulley 362, each of which align over and about a driven splined shaft 346. The opposing belt ends align over and about a yoke pulley 366, a pulley 368, and another yoke pulley 370 each of which is aligned over and about a splined shaft 372. The ends of the splined shaft 372 align in bearings 374 and 376 mounted on framework members 212*a* and 212*b*, respectively. The ends of the splined shaft 364 are supported by bearinged supports 378 and 380, which secure to the crossbar member 214*n*. The yoke bearings 358 and 362 are secured to brackets 382 and 384, each of which secure respectively to the take-up brackets 216 and 218 which are integral members of the adjustable guide plates 206 and 208. Corresponding yoke pulleys 366 and 370 secure via brackets 386 and 388 which secure to the adjustable guide plates 206 and 208.

The yoke pulleys 362, 364, 366, 370 and belts 352 and 356 also travel inwardly and outwardly in unison to the other members attached to guide plates 206 and 208 when they are adjusted inwardly or outwardly.

The belts 352–356 move at a faster rate than the flites 250 in order to minimize product backup along the length of the outflow conveyor section 204. This speedup of product is accomplished by appropriate and proper sprocket ratios as now described. A sprocket 390 is driven by the splined shaft 346 and linked by a drive chain to sprocket 392 on a shaft 394 appropriately secured to the conveyor framework 210. Another sprocket 396 on shaft 394 drives a sprocket 398 over the splined drive shaft by a drive chain, and thus turns the belts 352–356. The speed of each successive propulsion system, such as a conveyor, pressure belt system or off-load conveyor is faster than the preceding propulsion system to insure increasingly rapid movement of product packages through the package loader 200.

Figure 14:
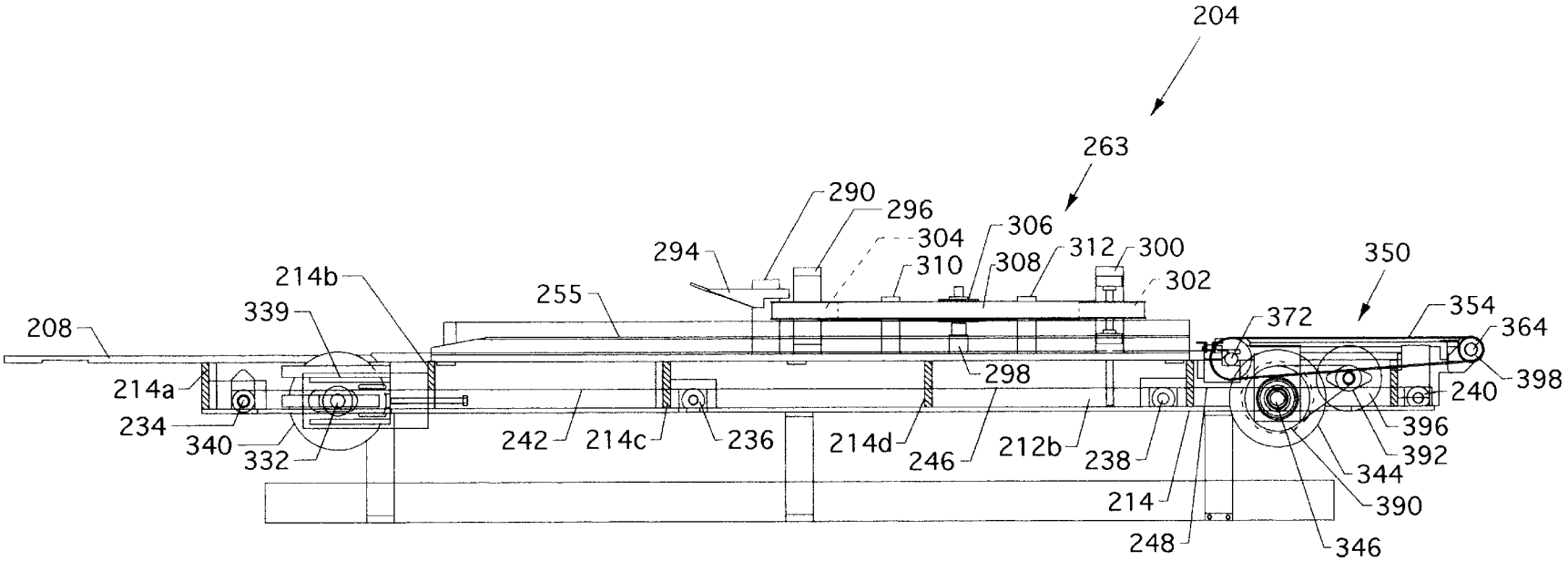
FIG. 14 illustrates a side plan view of the outflow conveyor section.

FIG. 14 illustrates a phantom side view in cross section through the approximate center of the outflow conveyor section 204 of FIGS. 13A and 13B where all numerals correspond to those elements previously described. The belts and pulleys of the off-load conveyor 350 are generally shown in their entirety. Illustrated in particular are the sprocketed adjustment screws 234–240 and the linking chains 242, 246 and 248 used for causing the adjustable guide plate 208 and the attached members to move simultaneously inwardly or outwardly with respect to the longitudinal axis of the outflow conveyor section.

Figure 15:
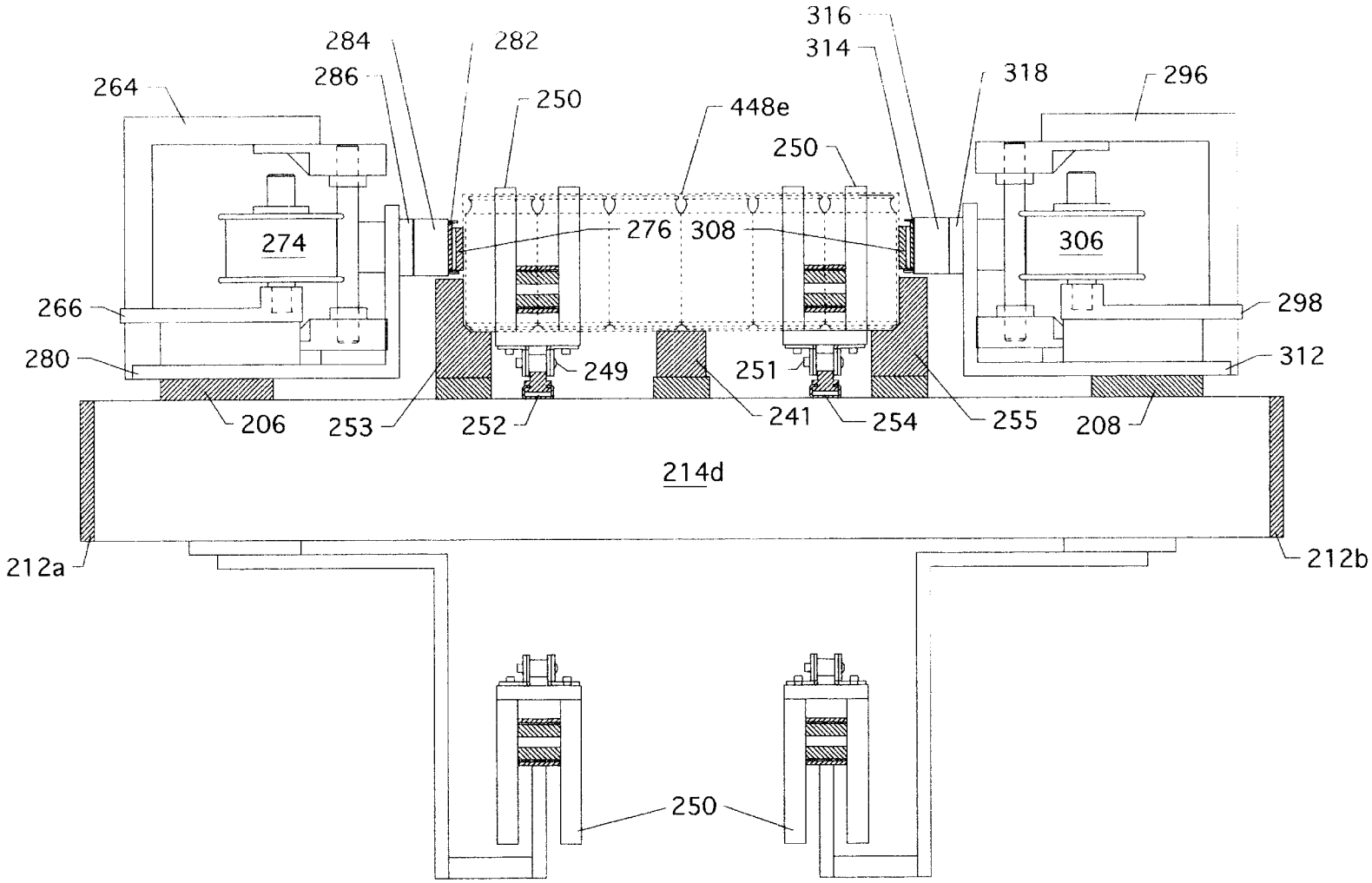
FIG. 15 illustrates a sectional view along line 15—15 of FIG. 11.

FIG. 15 illustrates a cross sectional view along line 15—15 of FIG. 11 where all numerals correspond to those elements previously described. Drive pulleys 270 and 302 are removed for purposes of brevity and clarity. Illustrated in particular are the guide members 241, 253 and 255 and the compression belts 276 and 308 used to compress the preglued package flaps against the side of a package 448*d*. Conveyor chains 249 and 251 and an attached plurality of flites 250 align on the conveyor chain guides 252 and 254.

Figure 16:
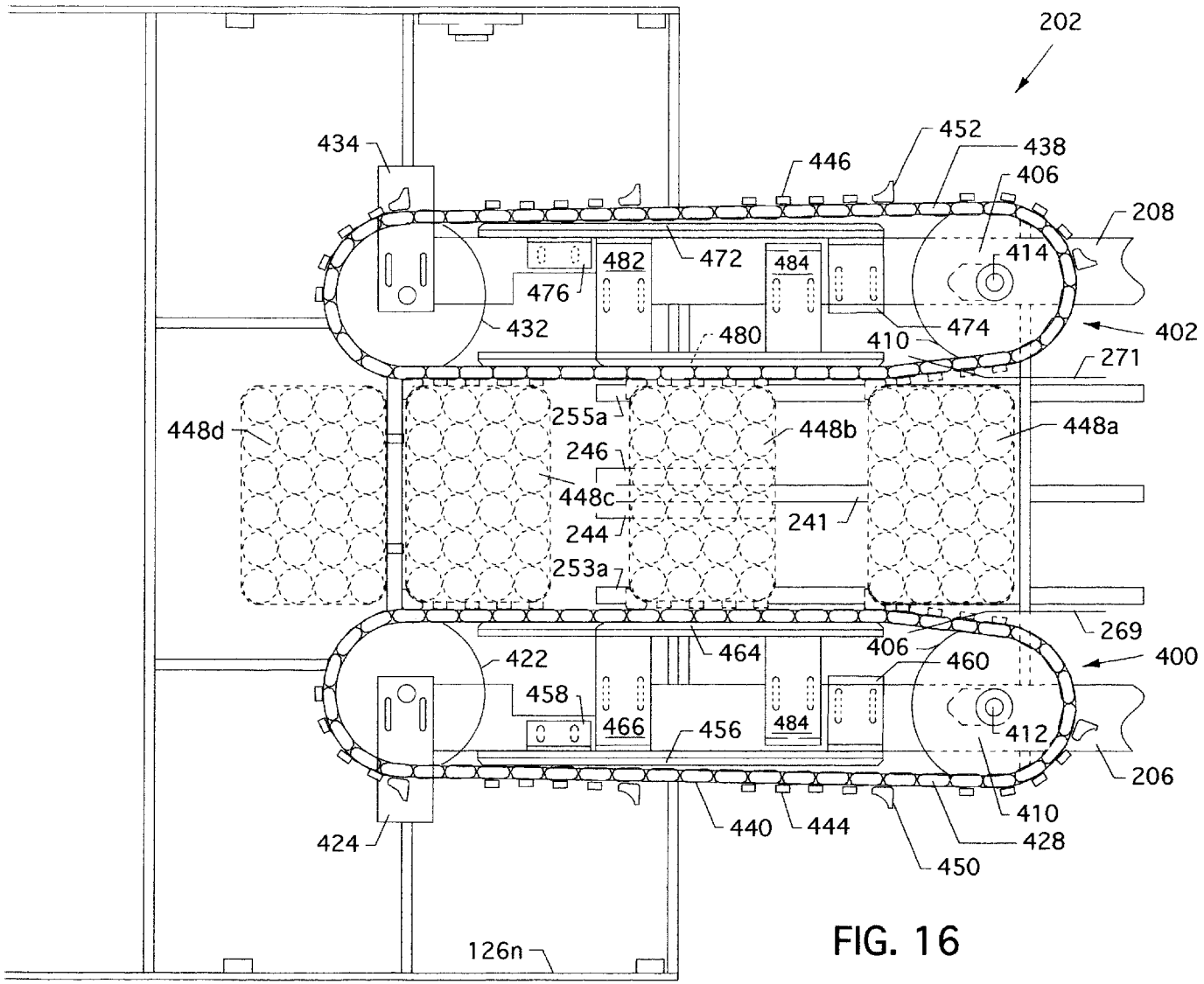
FIG. 16 illustrates a top plan view of the package transfer section.

FIG. 16 illustrates a top view of the package transfer section 202 where all numerals correspond to those elements previously described. The package transfer section 202 includes opposing and mirror image like transfer chain assemblies 400 and 402, the purpose of which is to gently grasp or urge a product package along the planar support member 241 and the support members 253*a*, 253, 255 and 255*a* without distorting the package and to transfer it from the central loading conveyor 90, illustrated in FIGS. 2B–2C and FIG. 11 to the flites 250 of the outflow conveyor section 204 of FIGS. 13A and 13B for further processing. The transfer chain assemblies 400 and 402 mount on and secure to the adjustable guide plates 206 and 208 respectively, and move in unison inwardly or outwardly with the attached members as previously described.

Figure 17:
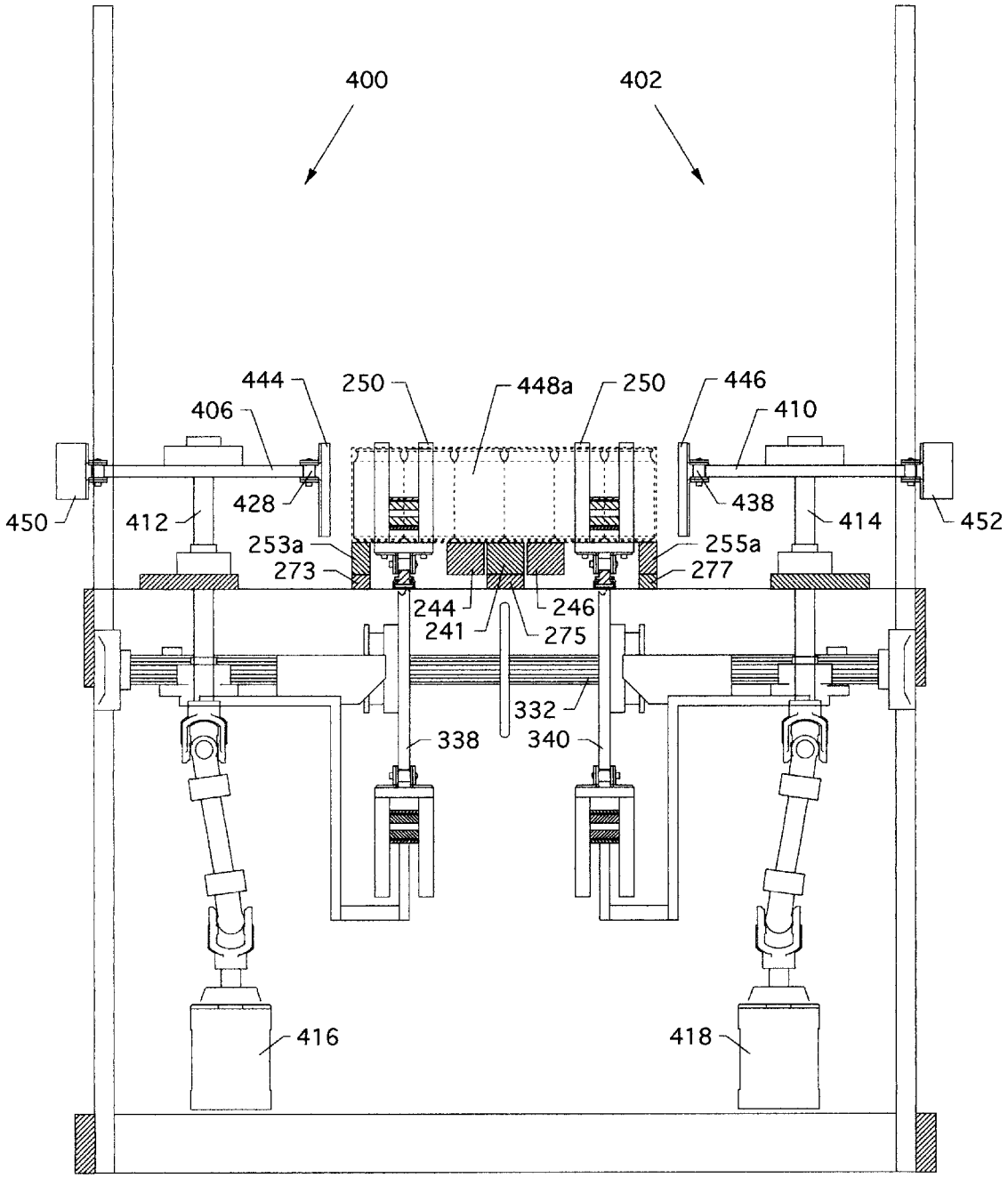
FIG. 17 illustrates a sectional view along lines 17—17 of FIG. 11.
Figure 18:
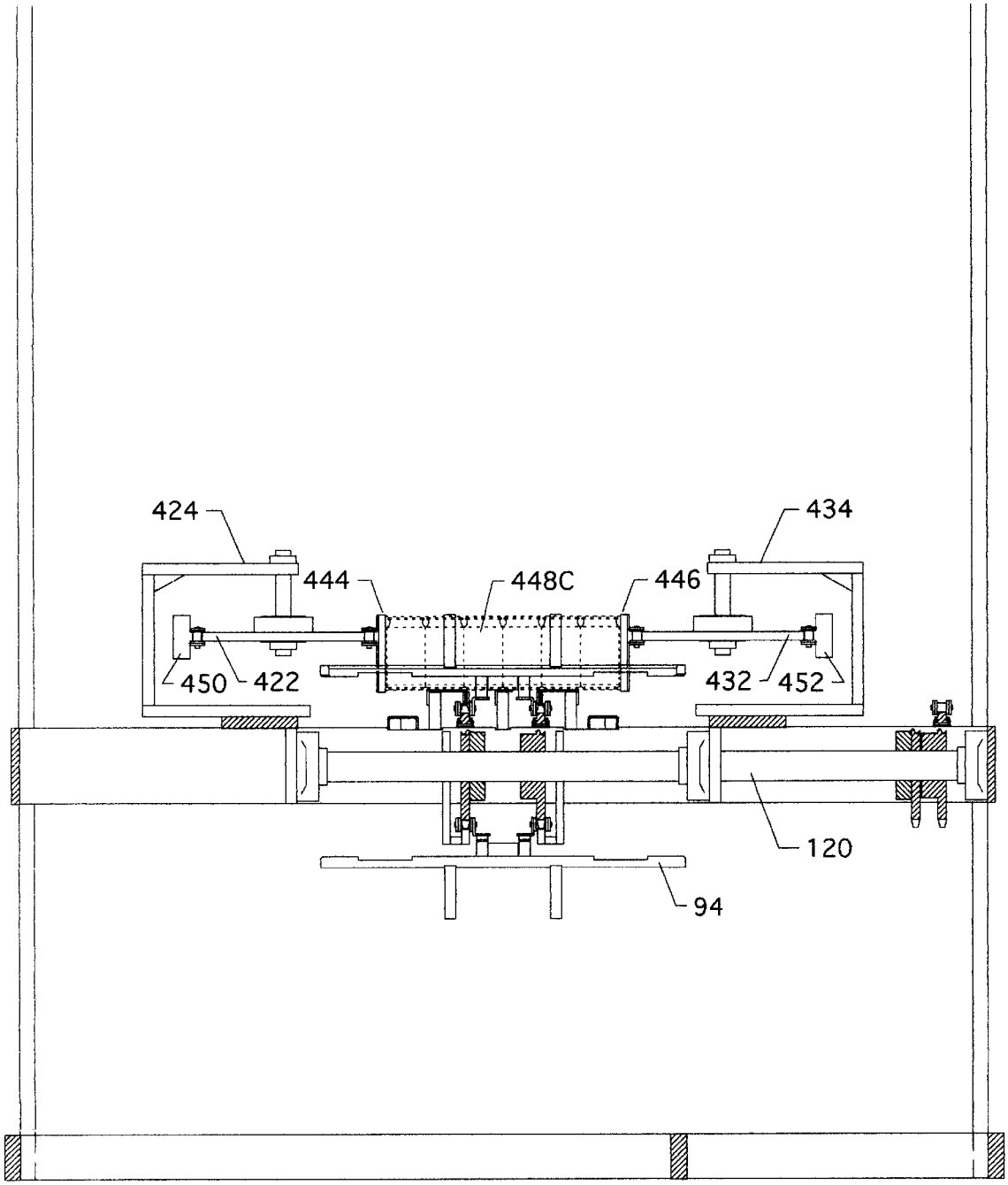
FIG. 18 illustrates a sectional view along lines 18—18 of FIG. 11.

It is observed with reference to this Figure and FIGS. 17 and 18 that each transfer chain assembly 400 and 402 includes a chain and other associated components secured to the adjustable guide plates 206 and 208. A drive sprocket 406 and a drive sprocket 410 are driven by shafts 412 and 414 and drive motors 416 and 418, respectively. A sprocket 422 secures to a shaft 423 on slotted bracket 424 on the adjustable guide plate 206 and aligns with the drive sprocket 406. A sprocket 432 secures to shaft 425 on a slotted bracket 434 on the adjustable guide plate 208 and aligns with the drive sprocket 410. A chain 428 aligns over and about the drive sprocket 405 and the sprocket 422. A chain 438 aligns over and about the drive sprocket 410 and the sprocket 432.

A plurality of contoured pusher fingers 450 and 452 secure to the chains 428 and 438 and are interspersed between a finite number of support plates 444 or 446 as illustrated. The contoured fingers 450 and 452 engage the corners of the packages 448*a*–448*d* to assist movement of the packages resting on support members 241, 253*a* and 255*a* and through the package transfer section 202 and onto the flites 250 of FIGS. 13A–13B. Outer chain guide 456 secures through slotted brackets 458 and 460, which in turn are secured to the adjustable guide plate 206. The inner chain guide 464 secures through slotted brackets 466 and 468, which in turn are secured to the adjustable guide plate 206. Correspondingly, outer chain guide 472 secures through slotted brackets 474 and 476, which in turn are secured to the adjustable guide plate 208. An inner chain guide 480 secures through slotted brackets 482 and 484 which in turn are secured to the adjustable guide plate 208.

FIG. 17 illustrates a sectional view along line 17—17 of FIG. 11 where all numerals correspond to those elements previously described. Illustrated in particular are the transfer chain assemblies 400 and 402.

FIG. 18 illustrates a sectional view of the package transfer section 202 along lines 18—18 of FIG. 11 where all numerals correspond to those elements previously described.

DESCRIPTION OF THE SECOND ALTERNATIVE EMBODIMENT

Figure 19:
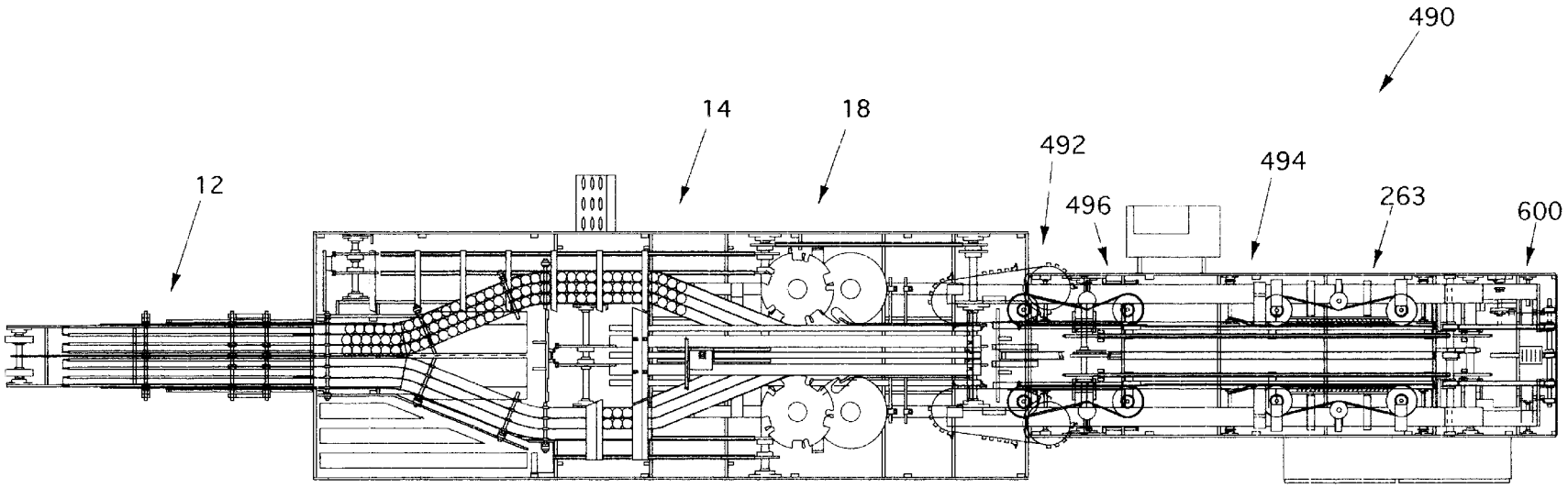
FIG. 19, a second alternative embodiment, illustrates a top plan view of a package loader constructed according to the present invention.

FIG. 19, a second alternative embodiment, illustrates a top plan view of a package loader 490 where all numerals correspond to those elements previously described. Included in the package loader 490 are an in-feed section 12, a product packaging section 14, a carton assembly section 16 of FIGS. 4A–4B, a carton gluing section 18 of the previous figures, and a package transfer section 492 transitioning to an outflow conveyor section 494. The package transfer section 492 is somewhat similar to and replaces the package section 202 of FIG. 11, and is used to transport product-laden cartons to the outflow conveyor section 494 after passing through the carton gluing section 18. The outflow conveyor section 494 is virtually similar in function and design to the outflow conveyor section 204, but with the inclusion of a dual pressure belt system 496 juxtaposed to the package transfer section 492. The off load conveyor 350 of previous figures is also replaced by an off load conveyor 650. The package transfer section 492 is illustrated in detail in the following figures.

Figure 20:
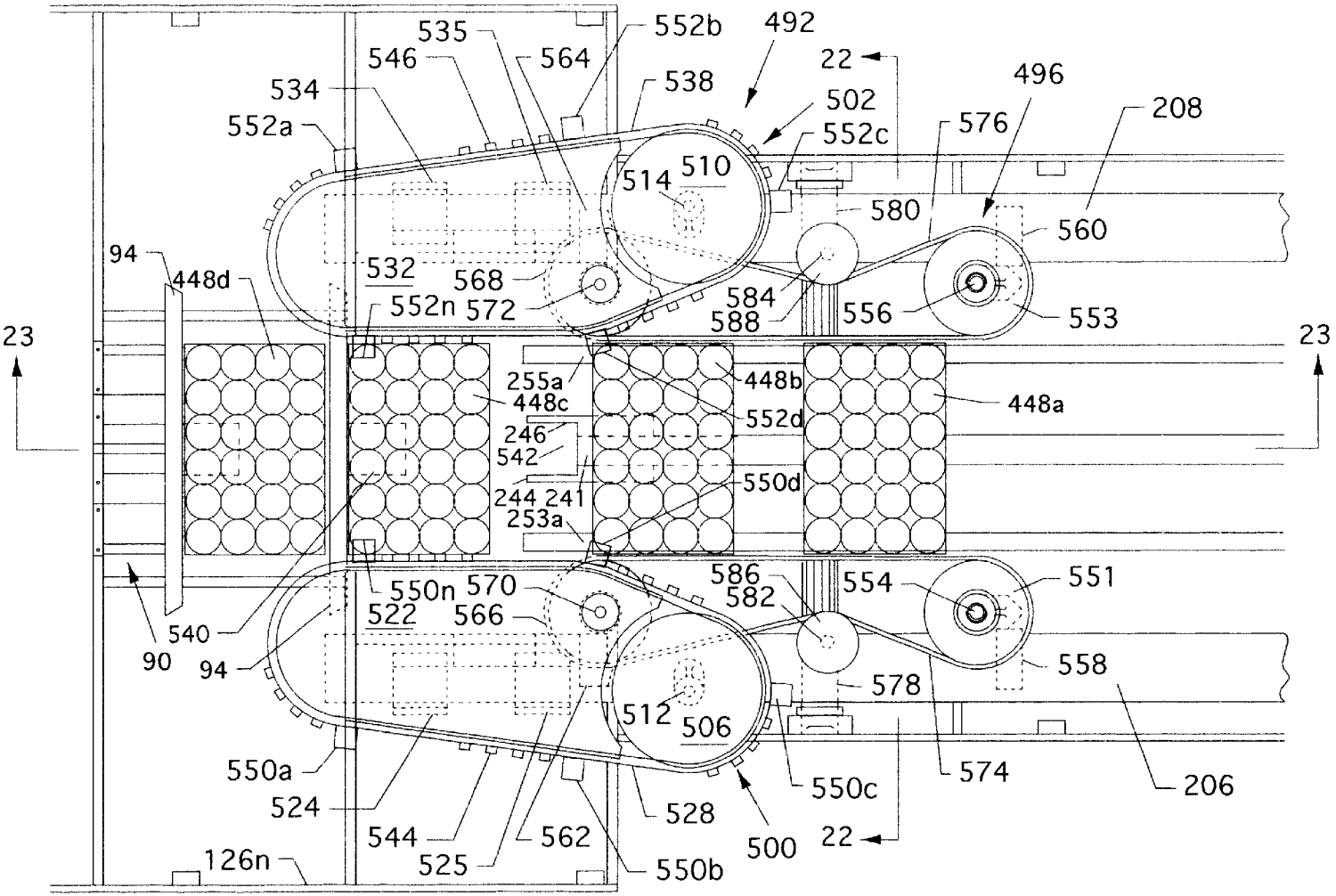
FIG. 20 illustrates a top plan view of the package transfer section.

FIG. 20 illustrates a top view of the package transfer section 492 where all numerals correspond to those elements previously described. The package transfer section 492 includes opposing and mirror image like transfer chain assemblies 500 and 502, the purpose of which is to gently grasp or urge a product package along the planar support member 241 and the support members 253*a*, 253, 255 and 255*a* without distorting the package and to transfer it from the flite bars 94 of the central loading conveyor 90, illustrated in FIGS. 2B–2C and FIG. 11 to the flites 250 of the outflow conveyor section 494 of FIGS. 13A and 13B for further processing. Horizontally aligned support plates 540 extend from the lower region of the flite bars 94 to support the middle section of the packaged members 448*a*–448*n*. A recess 542 cut in the ends of the planar support members 241, 244 and 246 accommodates the movement of the support plates 540 as described later in detail in FIGS. 23 and 24. The close intermeshing of the support plates 540 with the recess 542 in the ends of the planar support members 241, 244 and 246 provides for a smooth transition of the packaged members 448*a*–448*n* from the central loading conveyor 90 to the out flow conveyor section 494 without undue pitch movements of the packaged members. The transfer chain assemblies 500 and 502 mount on and secure to the adjustable guide plates 206 and 208 respectively, and move in unison inwardly or outwardly with the attached members as previously described.

Figure 22:
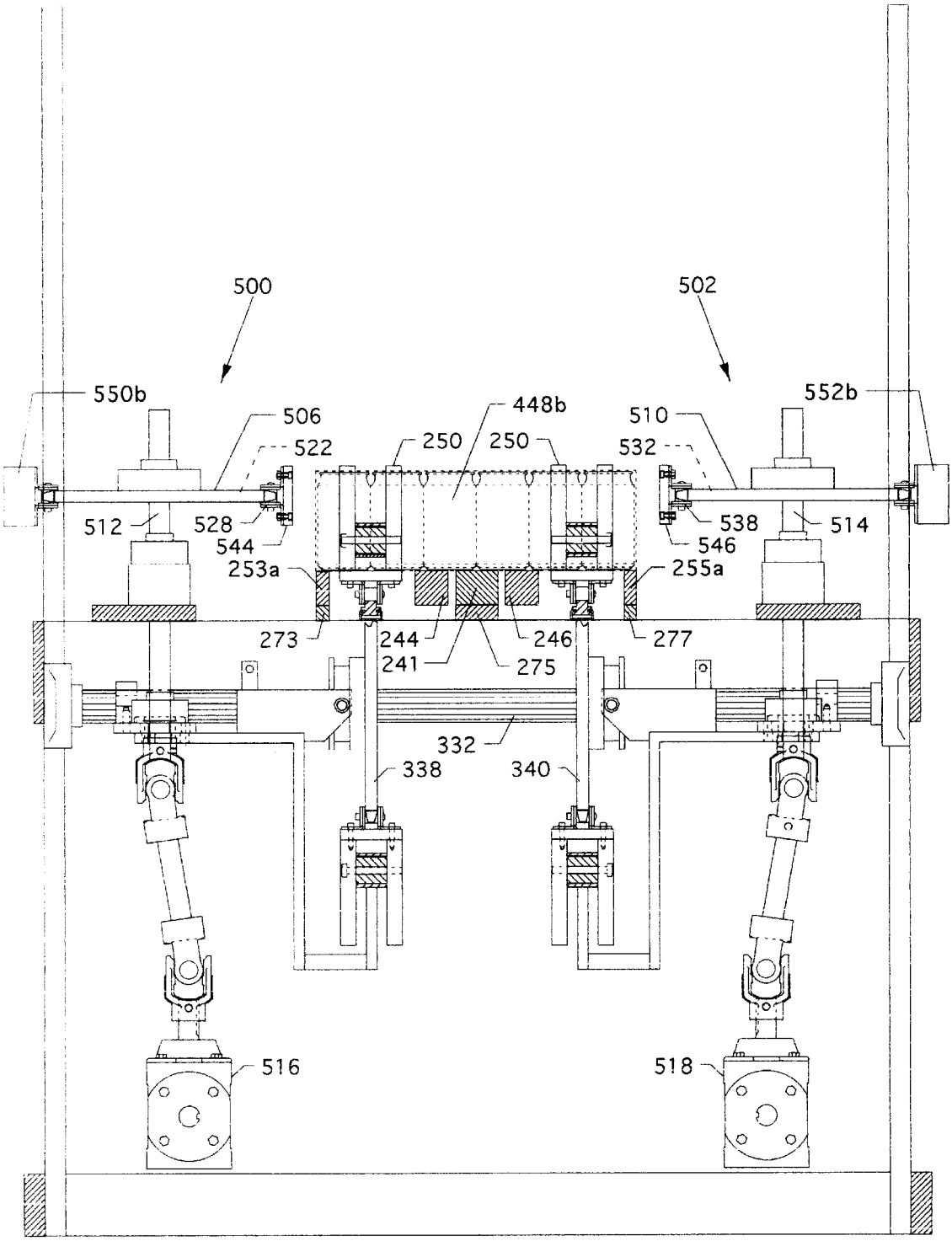
FIG. 22 illustrates a cross-sectional view along line 22—22 of FIG. 20 showing the transfer chain assemblies.

It is observed with reference to this Figure and FIG. 22 that each transfer chain assembly 500 and 502 includes a chain and other associated components secured to the adjustable guide plates 206 and 208. A drive sprocket 506 and a drive sprocket 510 are driven by shafts 512 and 514 and drive motors 516 and 518, respectively. A shaped chain track 522 secures to slotted brackets 524 and 525 on the adjustable guide plate 206 and aligns with the drive sprocket 506. A shaped chain track 532 secures to slotted brackets 534 and 535 on the adjustable guide plate 208 and aligns with the drive sprocket 510. A chain 528 aligns over and about the drive sprocket 506 and the shaped chain track 522. A chain 538 aligns over and about the drive sprocket 510 and the shaped chain track 532. The drive sprockets 506 and 510, which drive the chains 528 and 538, are driven in unison from the same power train which drives the components including those of the product packaging section 14 and the carton gluing section 18. The pressure belt systems 263 and 496 and the off load conveyor of the out flow conveyor system 494 of FIG. 19 are powered separately from the chains 528 and 538 so that the chains 528 and 538 may be readily stopped in the event of downed or missing product while the outflow conveyor section components continue operation to move packaged product from the site.

A plurality of contoured pusher fingers 550*a*–550*n* and 552*a*–552*n* secure to the chains 528 and 538 and are interspersed between a finite number of support plates 544 or 546 as illustrated. The contoured fingers 550*a*–550*n* and 552*a*–552*n* engage the corners of the packages 448*a*–448*d* to assist movement of the packages resting on support members 241, 253*a* and 255*a* and through the package transfer section 492 where the packages 448*a*–448*d* are subsequently grasped by the pressure belt system 496 and propelled onto the flites 250 of FIGS. 13A–13B.

The pressure belt system 496 is located in close proximity to the package transfer section 492 for quick and positive grasping action during transition of packaged product from the package transfer system 492 to the pressure belt system 496. The packaged product in fact is propelled, grasped and otherwise contacted first by the package transfer section 492 and thereby the pressure belt system 496, which operate at the same speeds.

The pressure belt system 496 is mounted on the adjustable guide plates 206 and 208 and includes driven pulleys 551 and 553 located on shafts 554 and 556 on adjustable brackets 558 and 560. Adjustable brackets 562 and 564 support pulleys 566 and 568 via shafts 570 and 572. Belts 574 and 576 align about pulleys 551 and 566 and pulleys 553 and 568, respectively. Adjustable brackets 578 and 580, having shafts 582 and 584 support belt tightener pulleys 586 and 588.

Figure 21:
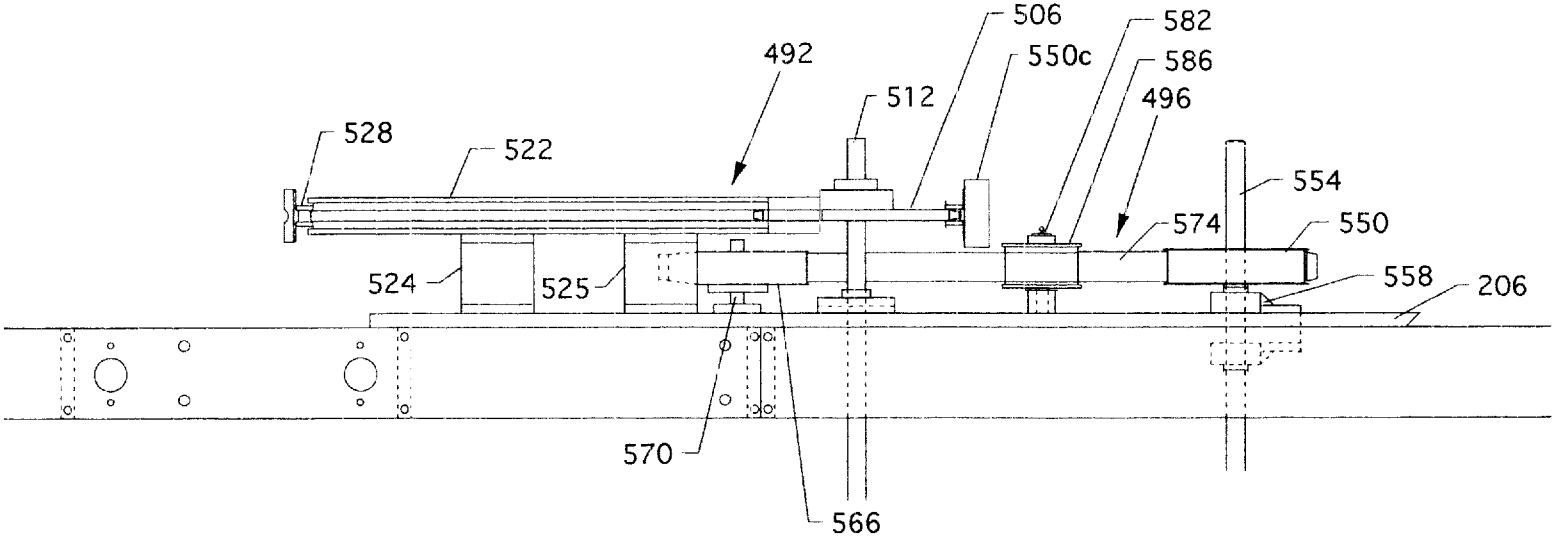
FIG. 21 illustrates a side view of the package transfer section and pressure belt system.

FIG. 21 illustrates a side view of FIG. 20 showing the package transfer section 492 and the pressure belt system 496 where all numerals correspond to those elements previously described. The package transfer section 492 overlays the lower lying pressure belt system 496 for positive throughput of package product.

FIG. 22 illustrates a cross-sectional view along line 22—22 of FIG. 20 showing the transfer chain assemblies 500 and 502 where all numerals correspond to those elements previously described.

Figure 23:
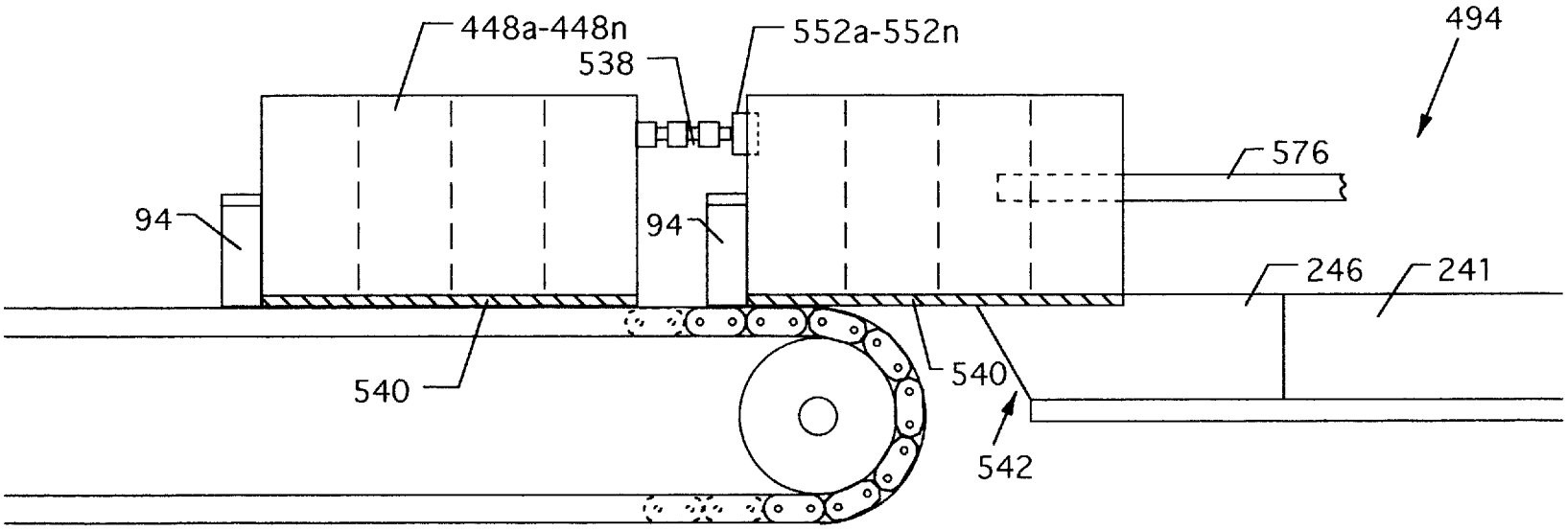
FIG. 23 illustrates a cross-sectional view along line 23—23 of FIG. 20.

FIG. 23 illustrates a cross-sectional view along line 23—23 of FIG. 20 illustrating the transfer of packages 448*a*–448*n* from the central loading conveyor 90 to the out flow conveyor section 494 where all numerals correspond to those elements previously described. The pusher fingers 550*a*–550*n* and 552*a*–552*n* assist in longitudinal package movement and support is lended to the center portion of the packages 448*a*–448*n* by the support plates 540, as well as the support by the outer support members of the central loading conveyor 90. The support plate 540 enters the cutout 542, thus supporting and carrying the packages 448*a*–448*n* so that, at the same time, the outer edges of the packages 448*a*–448*n* are thus deposited on the planar support members 246 and 241, 253*a* and 255*a* of FIG. 20. At this time the pusher fingers 550*a*–550*n* and 552*a*–552*n* start to disengage from contact with the package, the driven belts 576 (and 574) come into firm contact with the package and the support plate ceases to support the packaged member as it travels downwardly and out of the area of the cutout 542. The packaged items then proceed along the out flow conveyor 494.

Figure 24:
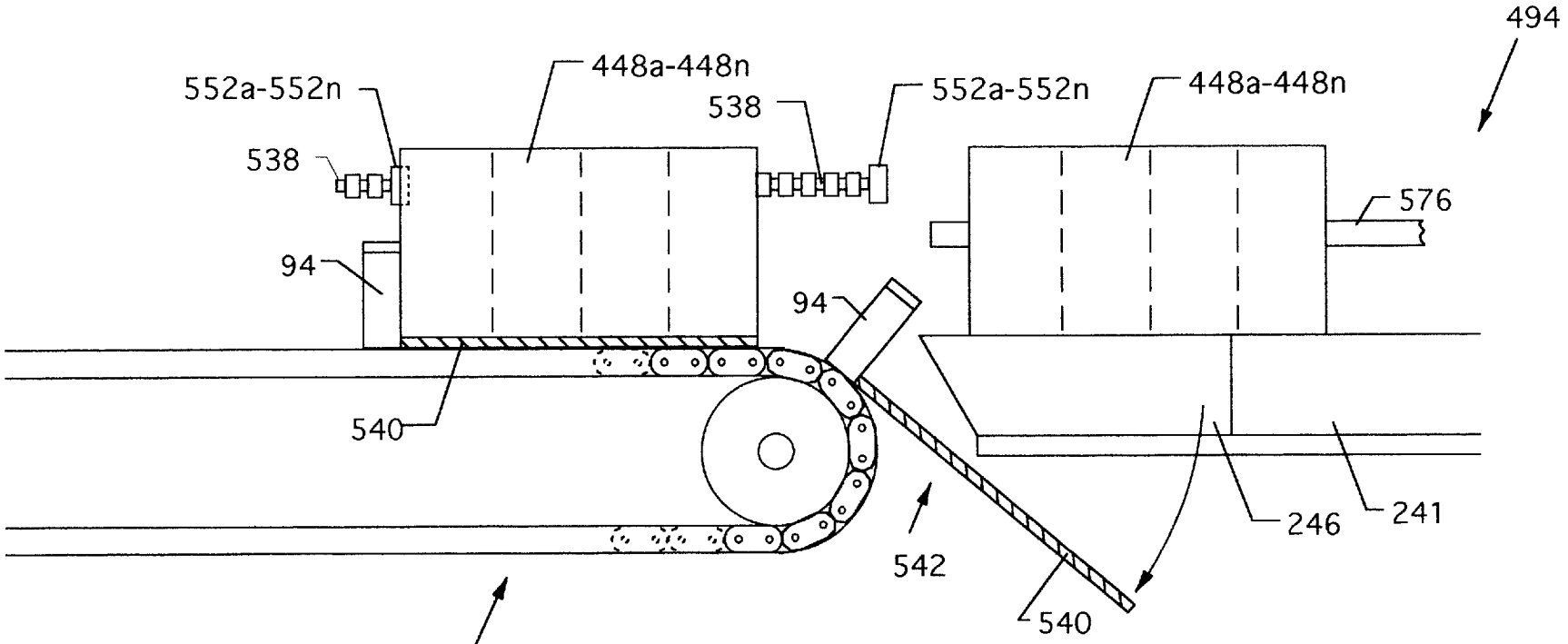
FIG. 24 illustrates a view of the descending support plate.

FIG. 24 illustrates a view of FIG. 23 where the support plate 540 is vacating the cutout 542 subsequent to deposition of the packaged member 448*a*–448*n* on the members of the outflow conveyor 494. All other numerals correspond those elements previously described.

Figure 25:
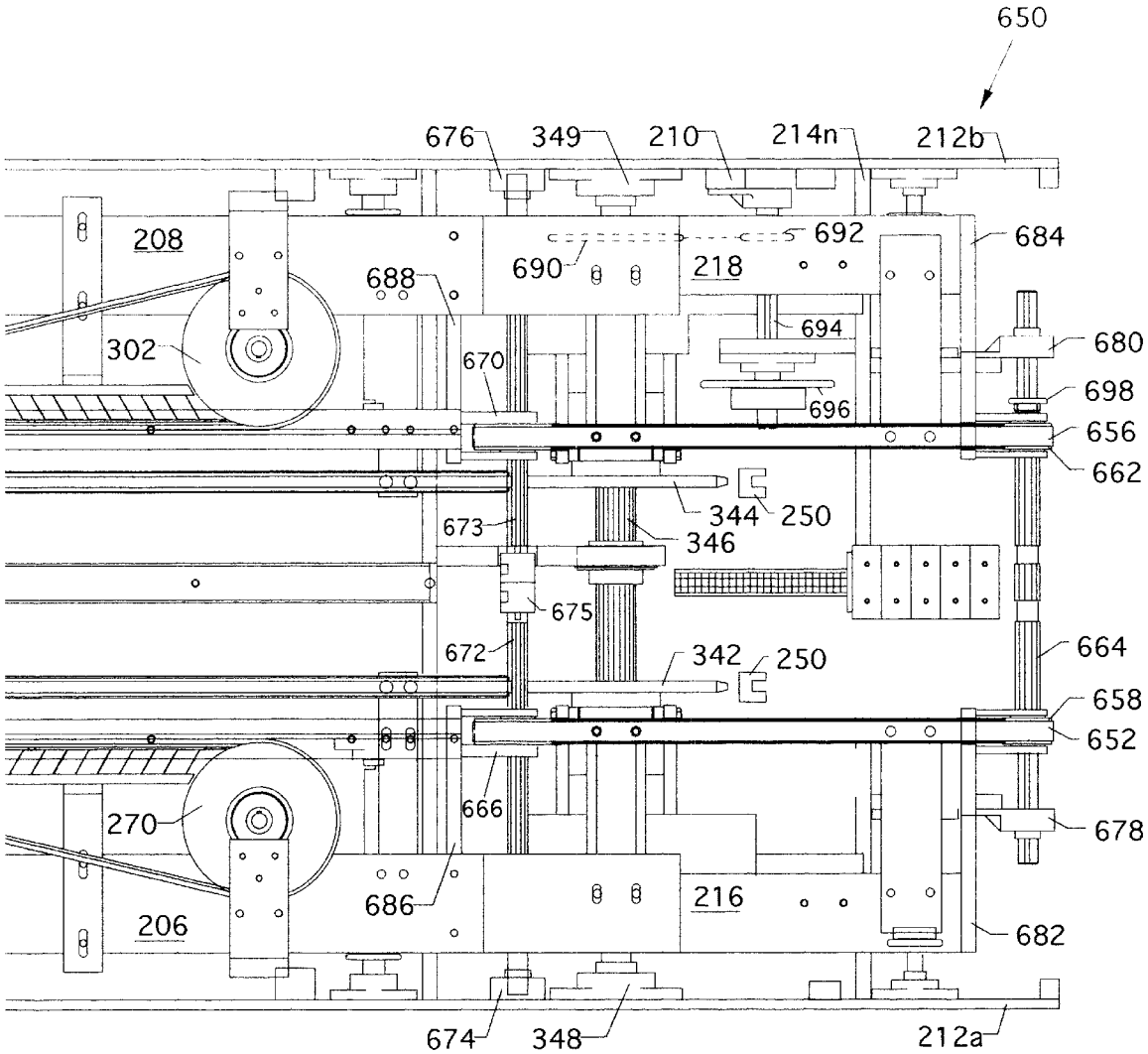
FIG. 25 illustrates an off loader with a split tail shaft.

FIG. 25 illustrates an off load conveyor 650 where all numerals correspond to those elements previously described. An off-load conveyor system 650 includes a plurality of driven belts including belts 652 and 656 aligned respectively over and about a yoke pulley 658 and another yoke pulley 662, each of which align over and about a driven splined shaft 664. The opposing belt ends align over and about a yoke pulley 666, and another yoke pulley 670 each of which is aligned over and about splined shafts 672 and 673. The ends of the split splined shafts 672 and 673 align in bearings 674 and 676 mounted on framework members 212*a* and 212*b*, respectively. A coupling 675 connects the split splined shafts 672 and 673 to improve change out replacement time for the belts 652 and 656. The coupling can be loosened, thus allowing the splined shafts 672 and 673 to be moved outwardly through the bearings 674 and 676 enough to allow new belts 652 and 656 access to the yoke pulleys 666 and 670 without time consuming removed of the yoke pulleys 666 and 670 and other associated devices. The ends of the splined shaft 664 are supported by bearinged supports 678 and 680, which secure to the cross-bar member 214*n*. The yoke bearings 658 and 662 are secured to brackets 682 and 684, each of which secure respectively to the take-up brackets 216 and 218 which are integral members of the adjustable guide plates 206 and 208. Corresponding yoke pulleys 666 and 670 secure via brackets 686 and 688 which secure to the adjustable guide plates 206 and 208.

The yoke pulleys 662, 664, 666, 670 and belts 652 and 656 also travel inwardly and outwardly in unison to the other members attached to guide plates 206 and 208 when they are adjusted inwardly or outwardly.

The belts 652–656 move at the same or a faster rate than the flites 250 in order to minimize product backup along the length of the outflow conveyor section 494. This speedup of product is accomplished by appropriate and proper sprocket ratios as now described. A sprocket 690 is driven by the splined shaft 346 and linked by a drive chain to sprocket 692 on a shaft 694 appropriately secured to the conveyor framework 210. Another sprocket 696 on shaft 694 drives a sprocket 698 over the splined drive shaft 664 by a drive chain, and thus turns the belts 652 and 656. The speed of each successive propulsion system, such as a conveyor, pressure belt system or off-load conveyor is faster than the preceding propulsion system to insure increasingly rapid movement of product packages through the package loader 490. A roller assembly 698 assist in flow of the packaged items from the off flow conveyor.

MODE OF OPERATION OF THE SECOND EMBODIMENT

The carton transfer section provides for gentle acceleration of loaded cartons to the carton sealing section, and is designed to assure all cartons are sealed even when the upstream portion of the machine stops due to low product supply. By gently extracting cartons from the infeed flites with the lug assembly, and positioning the carton with the aid of accelerator belts, the package is fully supported during the transfer. Additionally, confining of minor flaps during the transfer enables total control of the package and assures consistent carton sealing.

The packaging machine can pack and convey cartons with either square corners or round corners. The use of the lugs and transfer belts provides that the machine can almost "soft stop" at any position, and a hard controlled stop for FIGS. 19–25 is not required. The stop point is substantially uncritical. The critical controlled stop is no longer necessary because of the window for the lugs for stopping the machine. A critical controlled stop is no longer required.

The machine runs a variety of sizes and is easy to change over and is designed to run 12, 15, 16, 18, 20 or 24 count packages. Change over is mostly screw adjustable with predetermined stops. When switching from 12 to 24 counts, easily accessible parts are removed and screw adjustments are made. Change over is accomplished in about 30 minutes. The highly reliable shaft and gear driven rotary carton set up is designed for smooth operation. A 5' horizontal carton magazine makes carton loading easy. The packaging machine utilizes a method for grouping cans and preselects the cans in an operation separate from carton setup and loading. Preselection allows for down can detection/protection on the infeed. A separate inspection to verify proper compliment of cans just prior to insertion into cartons.

Various modifications can be made to the present invention without departing from the apparent scope hereof.

We claim:

1. A packaging system for inserting product into cartons comprising:

a. a carton conveyor for conveying partially assembled cartons having open flaps to be filled with product in a first direction;

b. a product conveyor for carrying product and for merging product into cartons;

c. a carton assembler for closing the flaps on cartons;

d. an outflow conveyor;

e. planar carton support members at a first portion of said outflow conveyor; and, f. a package transfer section including a pressure belt system having first and second opposing transfer belts, and first and second continuous transfer chain assemblies having first and second transfer chains, mounted on first and second sides of the carton conveyor, each transfer conveyor carrying fingers for engaging trailing corners of cartons as said cartons bearing product move from the carton conveyor and for transferring the cartons between said first and second transfer chains to said first and second opposing transfer belts.

2. The system of claim 1 wherein the transfer chains of the transfer chain assemblies include continuous chains.

3. The system of claim 1 wherein the transfer belts and transfer chain assemblies operate at the same speed.

4. The system of claim 1 wherein the outflow conveyor operates at a rate higher than said chains and transfer belts to move cartons away from the transfer section.

5. The system of claim 1 further comprising:

a. a frame;

b. two adjustable opposing guide plates mounted on the frame for movement perpendicular to the first direction, said guide plates mounted for movement inwardly toward the carton conveyor or outwardly away from the carton conveyor as the guide plates are adjusted;

c. the chains being mounted on the adjustable guide plates; and, d. the transfer belts being mounted on the adjustable guide plates.

6. The system of claim 5 further comprising:

a. multiple adjustment means for connecting the guide plates to the frame; and, b. the adjustment means being interconnected so that movement of one adjustment means is duplicated by all other adjustment means whereby an operator can adjust both guide plates simultaneously with one adjustment means.

7. The system of claim 1 wherein the fingers are contoured for gently engaging the cartons.

8. A packaging system for inserting product into cartons comprising:

a. a carton conveyor for conveying cartons to be filled in a first direction;

b. means for conveying product into the cartons;

c. an outflow conveyor including flights, lugs and belts for carrying away filled cartons;

d. a carton transfer section including a slide bar on which cartons slide, first and second guide plates mounted for lateral movement perpendicular to the first direction to allow for differing carton sizes, first and second transfer conveyors mounted on the first and second guide plates, respectively, having fingers for engaging cartons and for moving cartons along the slide bar from the carton conveyor to the outflow conveyor; and, e. a pressure belt system having first and second opposing transfer belts for transferring cartons from the carton conveyor to the outflow conveyor.

9. The system of claim 8 wherein the outflow conveyor moves at a rate faster than the carton conveyor to prevent jams and backup.

10. The system of claim 8 wherein the transfer conveyors include continuous chains mounted on the guide plates for carrying the fingers.

11. The system of claim 8 wherein the fingers are contoured for gently engaging the cartons.

12. A packaging system for inserting product into cartons comprising:

a. a carton conveyor for conveying partially assembled cartons having open flaps to be filled with product in a first direction;

b. a product conveyor for carrying product and for merging product into cartons;

c. a carton assembler for closing the flaps on cartons;

d. an outflow conveyor; and, e. a package transfer section including a pressure belt system having first and second opposing transfer belts, and first and second continuous transfer conveyors mounted on first and second sides of the carton conveyor, each transfer conveyor having a chain carrying fingers for engaging trailing corners of cartons as said cartons move off the carton conveyor and for transferring the cartons between said chains to the outflow conveyor.

13. The system of claim 12 wherein the transfer conveyors include continuous chains.

14. The system of claim 12 wherein the outflow conveyor operates at a rate higher than said chains to move cartons away from the transfer section.

15. The system of claim 12 further comprising:

a. a frame;

b. two adjustable opposing guide plates mounted on the frame for movement perpendicular to the first direction, said guide plates mounted for movement inwardly toward the carton conveyor or outwardly away from the carton conveyor as the guide plates are adjusted; and, c. the chains being mounted on the adjustable guide plates.

16. The system of claim 15 further comprising:

a. multiple adjustment means for connecting the guide plates to the frame; and, b. the adjustment means being interconnected so that movement of one adjustment means is duplicated by all other adjustment means whereby an operator can adjust both guide plates simultaneously with one adjustment means.

17. The system of claim 12 wherein the fingers are contoured for gently engaging the cartons.

18. The system of claim 15, wherein the adjustable opposing guide plates include slots and are mounted to the frame by screws extending through the slots.

19. The system of claim 18, wherein the slots include stops.

20. The system of claim 19, wherein the stops of the slots correspond to parameters of a carton to be filled with product.

21. The system of claim 20, wherein the carton to be filled has a filled capacity for items of product selected from the group consisting of 12, 15, 16, 18, 20 and 24 items of product.

22. The system of claim 21, wherein the product items are cans.

23. The system of claim 18, wherein the slots include a first stop, corresponding to a predetermined adjustment for filling a first carton type with 12 cans, and a second stop, corresponding to a predetermined adjustment for filling a second carton type with 24 cans.

24. An adjustable packaging system for inserting product into cartons selected from a first carton type and a second carton type, the system comprising:

a. a frame;

b. a carton conveyor for conveying partially assembled cartons selected from first carton type or second carton type cartons having open flaps to be filled with a corresponding count of product in a first direction;

c. two adjustable opposing guide plates mounted on the frame for movement perpendicular to the first direction, said guide plates mounted for movement between a position for guiding cartons of the first carton type and a position for guiding cartons of the second carton type as the cartons are conveyed by the carton conveyor;

d. a product conveyor for carrying product and for merging product into cartons selected from the first carton type or the second carton type;

e. a carton assembler for closing the flaps on cartons selected from the first carton type or the second carton type;

f. an outflow conveyor; and, g. a package transfer section including a pressure belt system having first and second opposing transfer belts, and first and second continuous transfer conveyors mounted on first and second sides of the carton conveyor, each transfer conveyor having a chain carrying fingers for engaging trailing corners of cartons as said cartons move off the carton conveyor and for transferring the cartons between said chains to the outflow conveyor, the chains being carried on the adjustable opposing guideplates.

25. The adjustable system of claim 24, further comprising:

a. means for securing the adjustable guide plates to the frame in the position corresponding to the first carton type and, alternately, in the position corresponding to the second carton type.

26. The adjustable system of claim 25, wherein the means for securing includes a screw in a slot.

27. The adjustable system of claim 26, wherein the slot includes first and second stops corresponding to the first carton type position and the second carton type position respectively.

28. The adjustable system of claim 24, wherein the two adjustable guide plates are interconnected so that both guideplates are either in the first carton type position or the second carton type position, and such that movement of one adjustable guideplate produces simultaneous movement of the opposing adjustable guideplate.

29. The adjustable system of claim 24, wherein the first carton type is a 12 can carton and the second type is a 24 can carton.

* * * * *